US007356985B2

(12) United States Patent
Hirata et al.

(10) Patent No.: US 7,356,985 B2
(45) Date of Patent: Apr. 15, 2008

(54) AIR-FUEL RATIO CONTROLLER FOR INTERNAL COMBUSTION ENGINE

(75) Inventors: Yasuo Hirata, Chita-gun (JP); Akihiro Okamoto, Hashima-gun (JP); Keiji Wakahara, Inazawa (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/483,602

(22) Filed: Jul. 11, 2006

(65) Prior Publication Data

US 2007/0017210 A1 Jan. 25, 2007

(30) Foreign Application Priority Data

Jul. 19, 2005 (JP) ..... 2005-208140
Feb. 7, 2006 (JP) ..... 2006-029811

(51) Int. Cl.
*F02D 41/14* (2006.01)

(52) U.S. Cl. ..... 60/274; 60/276; 123/673; 701/109

(58) Field of Classification Search ..... 123/673, 123/674, 675; 60/274, 276; 701/109
See application file for complete search history.

(56) References Cited

U.S. PATENT DOCUMENTS 5,657,736 A 8/1997 Maki et al. ..... 123/673
5,730,111 A 3/1998 Kaji et al. ..... 123/673
6,029,641 A * 2/2000 Suzuki et al. ..... 123/673
7,063,080 B2 * 6/2006 Kita et al. ..... 123/673
7,195,008 B2 * 3/2007 Annoura et al. ..... 123/674
2005/0022797 A1 2/2005 Ikemoto et al. ..... 123/673

FOREIGN PATENT DOCUMENTS

| | | |
|---|---|---|
| DE | 10 2004 026 176 B3 | 8/2005 |
| JP | 3-37020 | 6/1991 |
| JP | 10-9038 | 1/1998 |
| JP | 11-200926 | 7/1999 |
| JP | 2005-42676 | 2/2005 |

* cited by examiner

*Primary Examiner*—T. M Argenbright

(57) ABSTRACT

A target air-fuel ratio setting part has a sub-feedback part, a target air-fuel ratio enriching part, and a target air-fuel ratio changeover part. The sub-feedback part variably sets a target air-fuel ratio upstream of a catalyst on the basis of a detection signal of an O2 sensor provided downstream of the catalyst. The target air-fuel ratio changeover part uses, as the target air-fuel ratio, a rich target air-fuel ratio which is set by the target air-fuel ratio enriching part on conditions such that the target air-fuel ratio set by the sub-feedback part is rich. A cylinder-by-cylinder air-fuel ratio estimation part calculates a cylinder-by-cylinder air-fuel ratio on the basis of a detection value of an air-fuel ratio sensor and the target air-fuel ratio.

18 Claims, 21 Drawing Sheets

AIR-FUEL RATIO CONTROLLER FOR INTERNAL COMBUSTION ENGINE

CROSS-REFERENCE TO RELATED APPLICATION

This application is based on Japanese Patent Applications No. 2005-208140 filed on Jul. 19, 2005, and No. 2006-29811 filed on Feb. 7, 2006, the disclosure of which are incorporated herein by reference.

FIELD OF THE INVENTION

The present invention relates to a cylinder-by-cylinder air-fuel ratio controller for an internal combustion engine, for controlling the air-fuel ratio of each cylinder on the basis of a detection value of one air-fuel ratio sensor installed in an exhaust collection part in an internal combustion engine.

BACKGROUND OF THE INVENTION

JP-8-338285A (U.S. Pat. No. 5,730,111) discloses a technique in which, to improve air-fuel ratio control accuracy by reducing variations in the air-fuel ratio among cylinders of an internal combustion engine, at the time of performing air-fuel ratio detection by an air-fuel ratio sensor, a cylinder from which an exhaust to be actually detected came is specified and a feedback control of the air-fuel ratio is performed on the specified cylinder.

JP-3-37020B discloses a technique in which an air-fuel ratio of an exhaust collection part is detected using an air-fuel ratio sensor, and in view of a delay until the exhaust of a cylinder reaches the air-fuel ratio sensor, the fuel supply amount of the cylinder is corrected.

It is considered that the response of the air-fuel ratio sensor varies between the case where a rich output is detected and the case where a lean output is detected. Therefore, a sensor output of high response and a sensor output of low response mixedly exist and a problem occurs such that variations among cylinders cannot be eliminated with reliability.

Japanese Patent No. 3217680 (U.S. Pat. No. 5,657,736) discloses a system in which a model describing the behavior of an exhaust system in an internal combustion engine is set. A detection value of one air-fuel ratio sensor mounted in an exhaust collection part (an air-fuel ratio of exhaust gas flowing in the exhaust collection part) is inputted to the model. The air-fuel ratio of each cylinder is estimated by an observer for observing the internal state. The fuel injection amount of each cylinder is corrected according to the deviation between the estimated air-fuel ratio of each cylinder and a target value, thereby making the air-fuel ratio of each cylinder coincide with the target value. In the system, considering that a delay since an exhaust gas exhausted from each cylinder reaches around the air-fuel ratio sensor until the air-fuel ratio of the exhaust gas is detected (hereinbelow, called "response delay of the exhaust system") changes according to the engine operating state, a map specifying the relation between the response delay of the exhaust system and the engine operating state is created in advance. The timing of sampling an output of the air-fuel ratio sensor (the air-fuel ratio detection timing of each cylinder) is changed with reference to the map in accordance with the engine operating state.

Japanese Patent No. 3217680 also discloses a technique such that, at the time of changing the air-fuel ratio detection timing in accordance with the engine operating state, the air-fuel ratio detection timing is changed in consideration of not only the engine speed, the intake pressure, and the valve timing but also the air-fuel ratio. It describes the relation between response (reaction time) of the air-fuel ratio sensor and the air-fuel ratio as follows. "Since the air-fuel ratio sensor response time becomes shorter when the air-fuel mixture is lean than in the case when the air-fuel mixture is rich, it is preferable to detect the air-fuel ratio at an earlier crank angle (that is, to advance the air-fuel ratio detection timing) when the air-fuel ratio to be detected is lean". According to a recent study result of the inventors herein, it was found that the change characteristic of the deviation of the air-fuel ratio detection timing according to the air-fuel ratio changes in two opposite ways. If the air-fuel ratio detection timing is advanced when the air-fuel ratio is lean, the air-fuel ratio detection timing is changed in the wrong way. When the air-fuel ratio detection timing of each cylinder is deviated from the proper value, the estimation accuracy of the air-fuel ratio of each cylinder deteriorates, and the state of the cylinder-by-cylinder air-fuel ratio control deteriorates.

SUMMARY OF THE INVENTION

An object of the invention is to provide an air-fuel ratio controller for an internal combustion engine, capable of excellently calculating a cylinder-by-cylinder air-fuel ratio reflecting variations among cylinders, and accurately executing air-fuel ratio control on the basis of the cylinder-by-cylinder air-fuel ratio.

Another object of the invention is to provide an air-fuel ratio controller for an internal combustion engine, capable of correcting the air-fuel ratio detection timing of each cylinder to a proper direction in accordance with an air-fuel ratio and realizing improvement in accuracy of air-fuel ratio estimation of each cylinder.

According to the invention, cylinder-by-cylinder air-fuel ratio calculating means calculates a cylinder-by-cylinder air-fuel ratio on the basis of a detection value of an air-fuel ratio sensor provided in an exhaust collection part in an internal combustion engine. In this case, particularly, in a state where an output of the air-fuel ratio sensor is a rich output, execution of calculation of the cylinder-by-cylinder air-fuel ratio by the cylinder-by-cylinder air-fuel ratio calculating means is permitted.

It is considered that the response of the air-fuel ratio sensor varies between the case where a rich output is detected and the case where a lean output is detected and, generally, the response when a rich output is detected is higher. Consequently, by executing calculation of the cylinder-by-cylinder air-fuel ratio only when a rich output is detected, deterioration in the calculation accuracy can be suppressed, and the cylinder-by-cylinder air-fuel ratio can be excellently calculated reflecting variations among cylinders. Therefore, the air-fuel ratio control can be executed with high accuracy on the basis of the cylinder-by-cylinder air-fuel ratio. Even in the case of using an air-fuel ratio whose response is deteriorating, by using a rich sensor output having relatively high response, the cylinder-by-cylinder air-fuel ratio can be calculated excellently.

According to the invention, air-fuel ratio detection timing correcting means for correcting the air-fuel ratio detection timing in accordance with a target air-fuel ratio or a detected air-fuel ratio corrects the air-fuel ratio detection timing so as to be retarded with respect to the stoichiometric air-fuel ratio when the target air-fuel ratio or the detected air-fuel ratio is lean, and corrects the air-fuel ratio detection timing so as to be advanced with respect to the stoichiometric air-fuel ratio when the target air-fuel ratio or the detected air-fuel ratio is rich. In such a manner, the air-fuel ratio detection timing can be corrected to a proper direction in accordance with the air-fuel ratio (the target air-fuel ratio or detected air-fuel ratio). Thus, the accuracy of air-fuel ratio estimation of each cylinder can be improved.

DETAILED DESCRIPTION OF EMBODIMENTS

First Embodiment

A first embodiment of the present invention will be described below with reference to the drawings. In the first embodiment, an engine control system is configured for an in-vehicle four-cylinder gasoline engine as a multi-cylinder internal combustion engine. In the control system, an electronic control unit for controlling an engine (hereinbelow, called engine ECU) is used as a center to perform a control on a fuel injection amount, a control on an ignition timing, and the like. First, the main components of the control system will be described with reference to FIG. 1.

Figure 1:
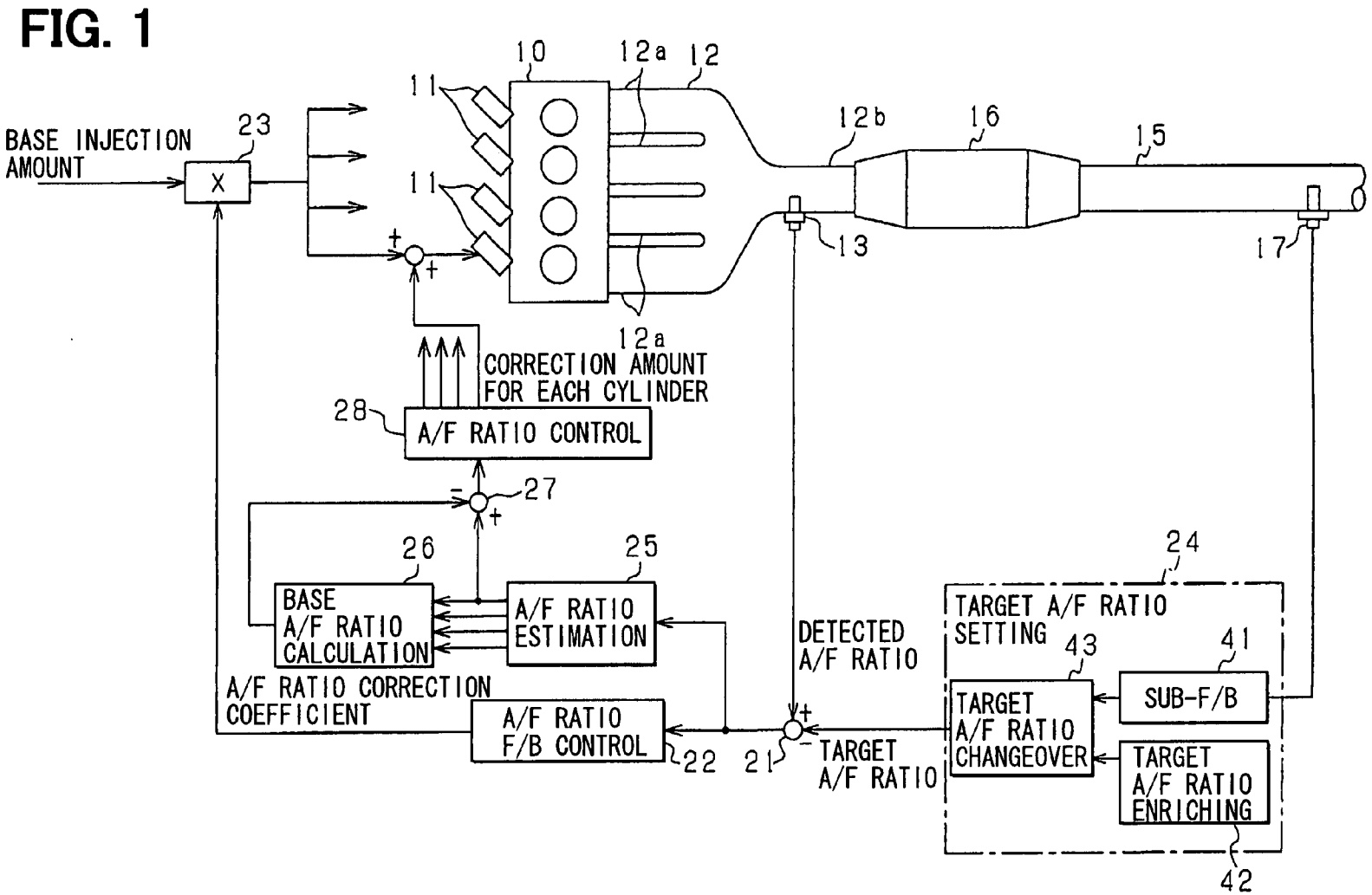
FIG. 1 is a configuration diagram schematically showing an engine control system according to a first embodiment.

In FIG. 1, an electromagnetically driven fuel injection valve 11 is attached to each of cylinders near intake ports of an engine 10. When a fuel is injected and supplied from the fuel injection valve 11 to the engine 10, the fuel injected by the fuel injection valve 11 is mixed with an intake air in the intake port of each cylinder, thereby generating air-fuel mixture. The air-fuel mixture is introduced into a combustion chamber of each cylinder as an intake valve (not shown) opens, and is used for combustion.

The air-fuel mixture provided for combustion in the engine 10 is exhausted as an exhaust via an exhaust manifold 12 as an exhaust valve (not shown) opens. The exhaust manifold 12 is constructed by branches 12*a* branched to the cylinders and an exhaust collection part 12*b* in which the branches 12*a* are collected. An air-fuel ratio sensor 13 for detecting the air-fuel ratio of the air-fuel mixture is provided for the exhaust collection part 12*b*. The air-fuel ratio sensor 13 is a so-called whole-area air-fuel ratio sensor capable of linearly detecting the air-fuel ratio in a wide range. Since the configuration of the sensor is known, its detailed description will not be given here. Briefly, the air-fuel ratio sensor 13 has a solid electrolyte layer made of zirconia or the like and a pair of electrode layers (an exhaust-side electrode and an atmosphere-side electrode) disposed so as to sandwich the solid electrolyte layer. A diffusion resistance layer is provided on the outer side of the exhaust-side electrode. The air-fuel ratio sensor 13 detects oxygen concentration in the exhaust (that is, the air-fuel ratio) in accordance with an amount of oxygen ions that migrate between the electrodes.

An exhaust pipe 15 is connected downstream of the exhaust manifold 12, and a three-way catalyst 16 is provided for the exhaust pipe 15. An O2 sensor 17 is provided on the downstream side of the three-way catalyst 16 in the exhaust pipe 15. The O2 sensor 17 outputs an electromotive force signal in accordance with the oxygen concentration in the exhaust passing through the exhaust pipe 15 (particularly, the exhaust on the downstream side of the catalyst). The electromotive force signal varies according to whether the air-fuel ratio is rich or lean with respect to the stoichiometric air-fuel ratio as a border. Concretely, when the air-fuel ratio on the catalyst downstream side is rich, the electromotive force signal (O2 sensor output) becomes about 1V. When the air-fuel ratio is lean, the electromotive force signal (O2 sensor output) becomes 0V. The air-fuel ratio sensor 13 corresponds to "first air-fuel ratio sensor", and the O2 sensor 17 corresponds to "second air-fuel ratio sensor".

Although not shown, the control system is provided with not only the air-fuel ratio sensor 13 and the O2 sensor 17 but also various sensors. The various sensors include an intake pipe negative pressure sensor for detecting intake pipe negative pressure, a coolant temperature sensor for detecting engine water temperature, and a crank angle sensor for outputting a crank angle signal every predetermined crank angle of the engine. Like the detection signals of the air-fuel ratio sensor 13 and the O2 sensor 17, detection signals of the various sensors are properly input to the engine ECU.

In the control system, the air-fuel ratio is calculated on the basis of the detection signal of the air-fuel ratio sensor 13, and a fuel injection amount of each cylinder is feedback controlled so that the calculation value coincides with a target value. The basic configuration of the air-fuel ratio feedback control will be described with reference to FIG. 1. An air-fuel ratio deviation calculation part 21 calculates the deviation of a detected air-fuel ratio calculated from the detection signal of the air-fuel ratio sensor 13 from a target air-fuel ratio which is separately set. An air-fuel ratio feedback control part 22 calculates an air-fuel ratio correction coefficient on the basis of the deviation. An injection amount calculation part 23 calculates a final injection amount from a base injection amount calculated on the basis of engine speed, engine load (for example, intake pipe negative pressure), and the like, the air-fuel ratio correction factor, and the like. By the final injection amount, the fuel injection valve 11 is controlled. The flow of the control is similar to that of conventional air-fuel ratio feedback control.

In the air-fuel ratio feedback control, so-called sub-feedback control is executed. The sub-feedback control is a control for making the air-fuel ratio on the catalyst downstream side coincide with the target value (for example, around the stoichiometric air-fuel ratio). By the sub-feedback control, the target air-fuel ratio on the catalyst upstream side is variably set on the basis of the detection signal of the O2 sensor 17 provided on the catalyst downstream side. Specifically, a target air-fuel ratio setting part 24 determines whether the air-fuel ratio on the catalyst downstream side is rich or lean on the basis of the detection signal of the O2 sensor 17 and, on the basis of the determination result, properly sets the target air-fuel ratio. The details of the target air-fuel ratio setting part 24 will be described later.

The above-described air-fuel ratio feedback control is performed to control the fuel injection amount (air-fuel ratio) of each cylinder on the basis of the air-fuel ratio information detected by the exhaust collection part 12*b* of the exhaust manifold 12. However, the air-fuel ratio varies among the cylinders in reality. In the embodiment, therefore, the cylinder-by-cylinder air-fuel ratio is obtained from the detection value of the air-fuel ratio sensor 13 and cylinder-by-cylinder air-fuel ratio control is performed on the basis of the obtained cylinder-by-cylinder air-fuel ratio. The details will be described below.

As shown in FIG. 1, the air-fuel ratio deviation calculated by the air-fuel ratio deviation calculation part 21 is input to a cylinder-by-cylinder air-fuel ratio estimation part 25, and the cylinder-by-cylinder air-fuel ratio is estimated in the cylinder-by-cylinder air-fuel ratio estimation part 25. In the cylinder-by-cylinder air-fuel ratio estimation part 25, attention is paid to gas exchange in the exhaust collective part 12*b* of the exhaust manifold 12. A model is created in which a detection value of the air-fuel ratio sensor 13 is made one obtained by multiplying histories of cylinder-by-cylinder air-fuel ratios of an inflow gas in the exhaust collection part 12*b* and histories of detection values of the air-fuel ratio sensor 13 by specified weights and by adding them. On the basis of the model, the cylinder-by-cylinder air-fuel ratio is estimated. A Kalman filter is used as an observer.

More specifically, the model of the gas exchange in the exhaust collective part 12*b* is approximated by the following expression (1). In the expression (1), ys denotes the detection value of the air-fuel ratio sensor 13, u denotes an air-fuel ratio of the gas flowing into the exhaust collective part 12*b*, and k1 to k4 denote constants.

$$y_s(t)=k1*u(t-1)+k2*u(t-2)-k3*y_s(t-1)-k4*y_s(t-2) \quad (1)$$

In the exhaust system, there are a first order lag element of the gas inflow and mixture in the exhaust collective part 12*b* and a first order lag element due to the response of the air-fuel ratio sensor 13. In the expression (1), in consideration of these lag elements, the past two histories are referred to.

When the expression (1) is converted into a state space model, the following expression (2) is obtained. In the expression (2), A, B, C and D denote parameters of the model, Y denotes the detection value of the air-fuel ratio sensor 13, X denotes a cylinder-by-cylinder air-fuel ratio as a state variable, and W denotes noise.

$$X(t+1)=AX(t)+Bu(t)+W(t)$$

$$y(t)=CX(t)+Du(t) \quad (2)$$

Further, when the Kalman filter is designed by the expression (2), the following expression (3) is obtained. In the expression (3), X^ (X hat) denotes a cylinder-by-cylinder air-fuel ratio as an estimated value, and K denotes Kalman gain. The notation of X^(k+1|k) expresses that an estimated value at time k+1 is obtained based on an estimated value at time k.

$$\hat{X}(k+1|k)=A\cdot\hat{X}(k|k-1)+K\{Y(k)-C\cdot A\cdot\hat{X}(k|k-1)\} \quad (3)$$

As described above, the cylinder-by-cylinder air-fuel ratio estimation part 25 is constructed of the Kalman filter type observer, so that the cylinder-by-cylinder air-fuel ratio can be sequentially estimated as the combustion cycle proceeds. In the structure of FIG. 1, the air-fuel ratio deviation is the input of the cylinder-by-cylinder air-fuel ratio estimation part 25, and in the expression (3), the output Y is replaced by the air-fuel ratio deviation.

A base air-fuel ratio calculation part 26 calculates a base air-fuel ratio on the basis of the cylinder-by-cylinder air-fuel ratio estimated by the cylinder-by-cylinder air-fuel ratio estimation part 25. In this case, an average of the cylinder-by-cylinder air-fuel ratios of all cylinders (average value of the first to fourth cylinders in this embodiment) is used as the base air-fuel ratio. The base air-fuel ratio is updated each time a new cylinder-by-cylinder air-fuel ratio is calculated. A cylinder-by-cylinder air-fuel ratio deviation calculation part 27 calculates a deviation (cylinder-by-cylinder air-fuel ratio deviation) between the cylinder-by-cylinder air-fuel ratio and the base air-fuel ratio.

A cylinder-by-cylinder air-fuel ratio control part 28 calculates a cylinder-by-cylinder correction amount on the basis of the deviation calculated by the cylinder-by-cylinder air-fuel ratio deviation calculation part 27, and corrects a final injection amount for each cylinder by using the cylinder-by-cylinder correction amount. The more detailed structure of the cylinder-by-cylinder air-fuel ratio control part 28 will be described with reference to FIG. 2.

Figure 2:
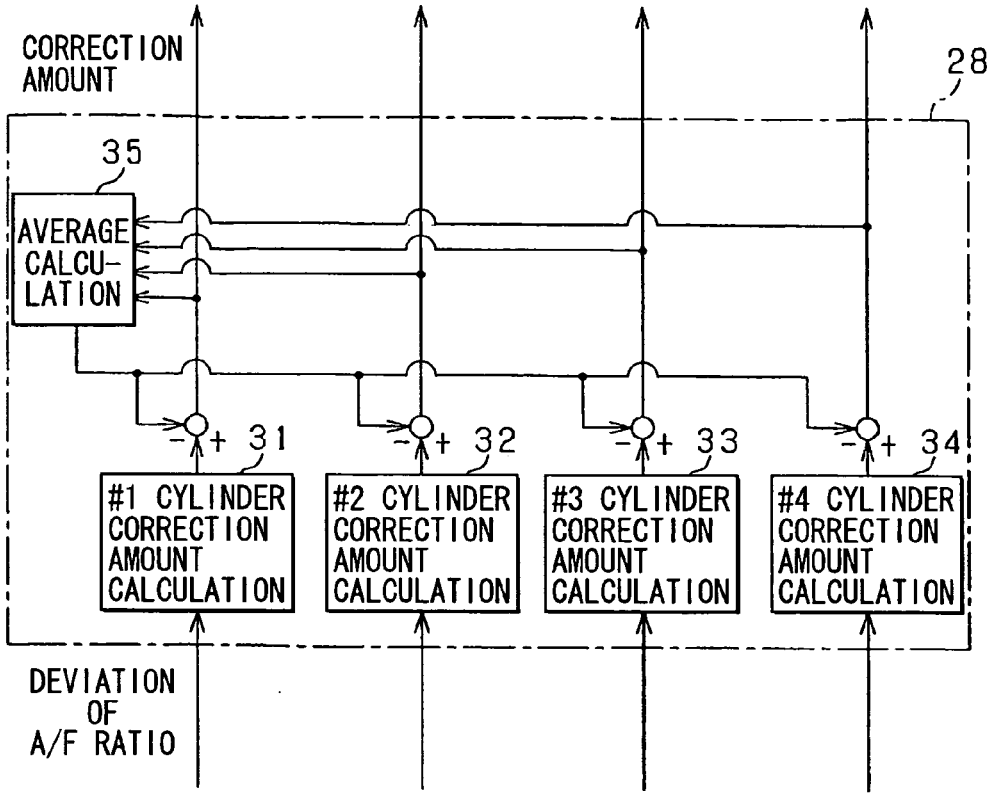
FIG. 2 is a block diagram showing the configuration of a cylinder-by-cylinder air-fuel ratio control part.

In FIG. 2, the cylinder-by-cylinder air-fuel ratio deviations (outputs of the cylinder-by-cylinder air-fuel ratio deviation calculation part 27 of FIG. 1) calculated cylinder by cylinder are input to correction amount calculation parts 31, 32, 33 and 34 for the first, second, third, and fourth cylinders, respectively. The correction amount calculation parts 31 to 34 calculate the cylinder-by-cylinder correction amounts so that variations in air-fuel ratios between the cylinders are eliminated on the basis of the cylinder-by-cylinder air-fuel ratio deviations, that is, the cylinder-by-cylinder air-fuel ratio of each cylinder coincides with the base air-fuel ratio. At this time, all of the cylinder-by-cylinder correction amounts calculated by the correction amount calculation parts 31 to 34 of the respective cylinders are taken into a correction amount average value calculation part 35, and an average value of the cylinder-by-cylinder correction amounts of the first cylinder to the fourth cylinder is calculated. The respective cylinder-by-cylinder correction amounts of the first cylinder to the fourth cylinder are corrected to decrease by the correction amount average value. As a result, the final injection amount of each cylinder is corrected according to the cylinder-by-cylinder correction amount after this correction.

Figure 3:
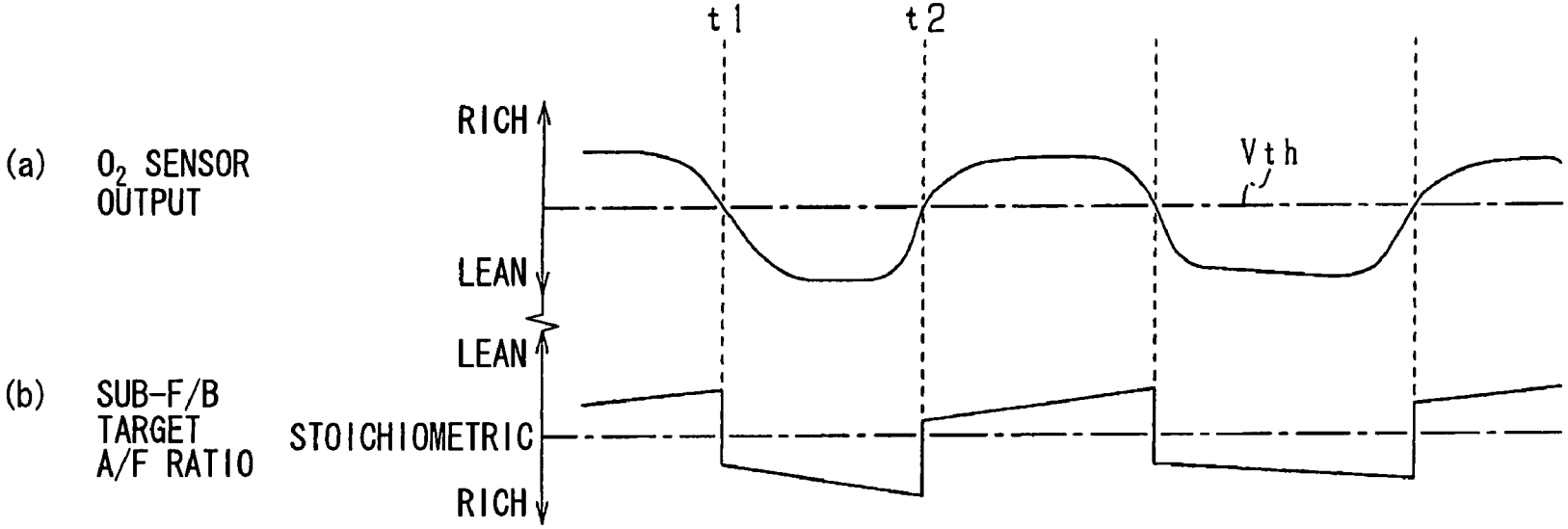
FIG. 3 is a time chart illustrating an outline of sub-feedback control.

The target air-fuel ratio setting part 24 will be described. The target air-fuel ratio setting unit 24 has a sub-feedback part 41, a target air-fuel ratio enriching part 42, and a target air-fuel ratio changeover part 43. The sub-feedback part 41 variably sets the target air-fuel ratio on the catalyst upstream side on the basis of a detection signal of the O2 sensor 17 (O2 sensor output) provided on the catalyst downstream side. The outline will be described with reference to the time chart of FIG. 3. In the following description, for convenience, the target air-fuel ratio which is set by the sub-feedback control will be called "sub-feedback target air-fuel ratio". In FIG. 3, Vth denotes a value for determining whether the O2 sensor output is rich or lean.

As shown in FIG. 3, the O2 sensor output periodically changes between a rich output and a lean output. According to the change, a sub-feedback target air-fuel ratio skipping process or a sub-feedback target air-fuel ratio integrating process is performed. For example, when the O2 sensor output changes from the rich side to the lean side at timing t1, the sub-feedback target air-fuel ratio is skipped to the rich side and, after that, the integrating process to the enriching direction is performed. When the O2 sensor output changes from the lean side to the rich side at timing t2, the sub-feedback target air-fuel ratio is skipped to the lean side and, after that, the integrating process to the leaning direction is performed.

The response of the air-fuel ratio sensor 13 when the rich state is detected and that when the lean state is detected are different from each other. Generally, the response is higher when the rich state is detected. Consequently, in the embodiment, to increase precision of the cylinder-by-cylinder air-fuel ratio control, the cylinder-by-cylinder air-fuel ratio is calculated only when the rich state is detected by the air-fuel ratio sensor 13. Further, at the time of calculating the cylinder-by-cylinder air-fuel ratio, the target air-fuel ratio is changed to a predetermined rich target air-fuel ratio. For the changing operation, the target air-fuel ratio enriching part 42 and the target air-fuel ratio changeover part 43 are provided.

In this case, the target air-fuel ratio changeover part 43 determines whether all of the following conditions are satisfied or not.

(1) Warming-up of the engine has completed.

(2) The engine operating state is in a predetermined execution condition satisfied state.

(3) The sub-feedback target air-fuel ratio which is set by the sub-feedback part 41 is on the rich side.

When all of the conditions are satisfied, the rich target air-fuel ratio which is set by the target air-fuel ratio enriching part 42 is set as a target air-fuel ratio. When any of the conditions is not satisfied, the sub-feedback target air-fuel ratio which is set by the sub-feedback part 41 is set as a target air-fuel ratio.

An amplitude amount to the rich side and the lean side of the target air-fuel ratio which is changed by the sub-feedback control is about 1% from the stoichiometric air-fuel ratio (target $\lambda$=about 1±0.01). On the other hand, the rich target air-fuel ratio is about 2% to 3% from the stoichiometric air-fuel ratio (target $\lambda$=about 1±0.02 to 0.03).

Alternatively, the target air-fuel ratio enriching part 42 can variably set the rich target air-fuel ratio on the basis of engine speed, load, or the like. In this case, it is preferable to decrease the rich degree as the rotation or load increases. It is also possible to provide a base target air-fuel ratio setting part for setting a base value of the target air-fuel ratio on the basis of engine operating state or the like and to allow the sub-feedback part 41 make a correction based on the O2 sensor output onto the base value of the target air-fuel ratio.

The foregoing air-fuel ratio deviation calculation part 21, the air-fuel ratio feedback control part 22, the injection amount calculation part 23, the target air-fuel ratio setting part 24, the cylinder-by-cylinder air-fuel ratio estimation part 25, the base air-fuel ratio calculation part 26, the cylinder-by-cylinder air-fuel ratio deviation calculation part 27, and the cylinder-by-cylinder air-fuel ratio control part 28 are realized by a microcomputer in the engine ECU.

Figure 4:
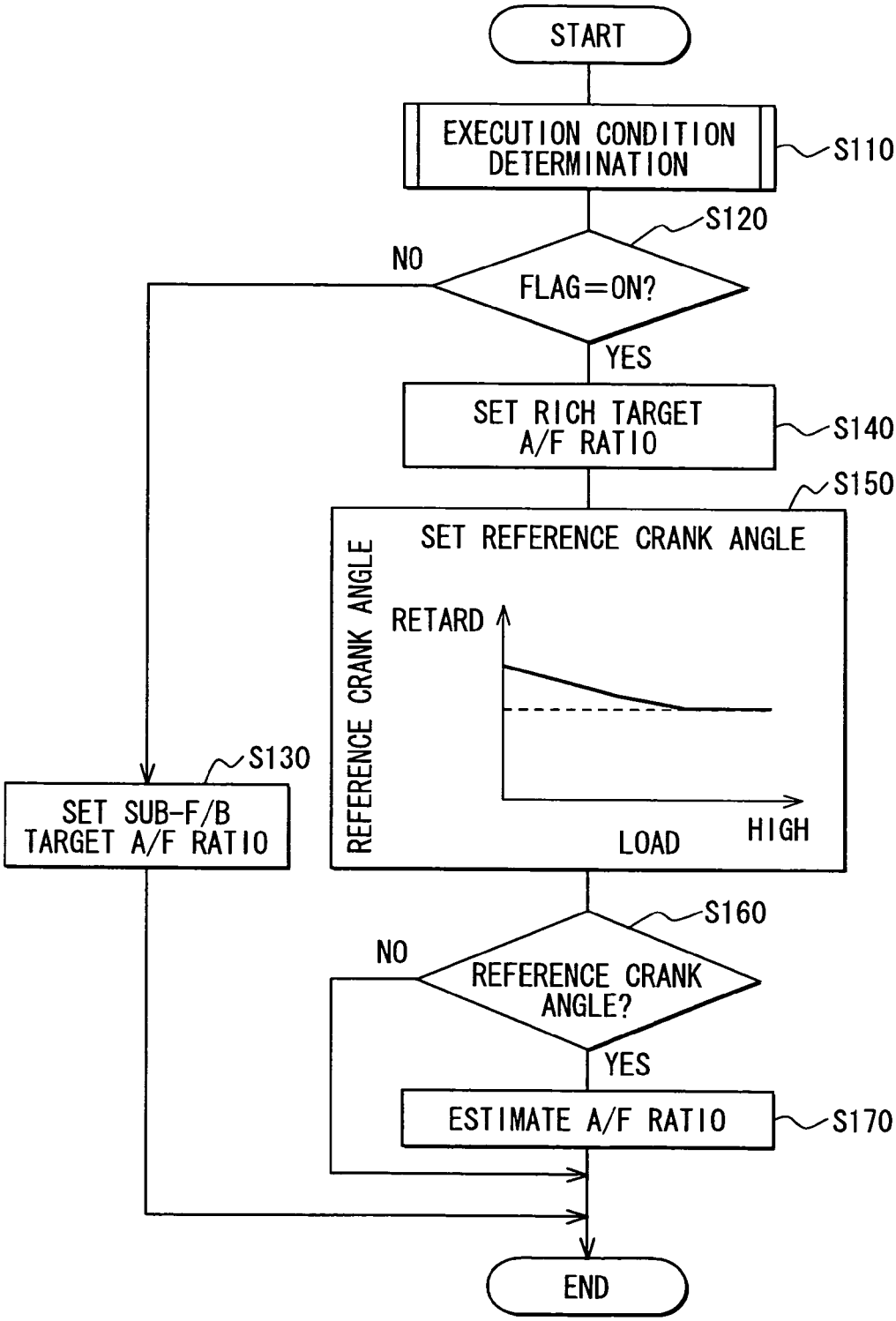
FIG. 4 is a flowchart showing a cylinder-by-cylinder air-fuel ratio estimating process.

Next, the flow of a series of the cylinder-by-cylinder air-fuel ratio estimating process performed by the engine ECU will be described. FIG. 4 is a flowchart showing the cylinder-by-cylinder air-fuel ratio estimating process which is executed by the engine ECU every predetermined crank angle (every 30° CA in this embodiment).

Figure 5:
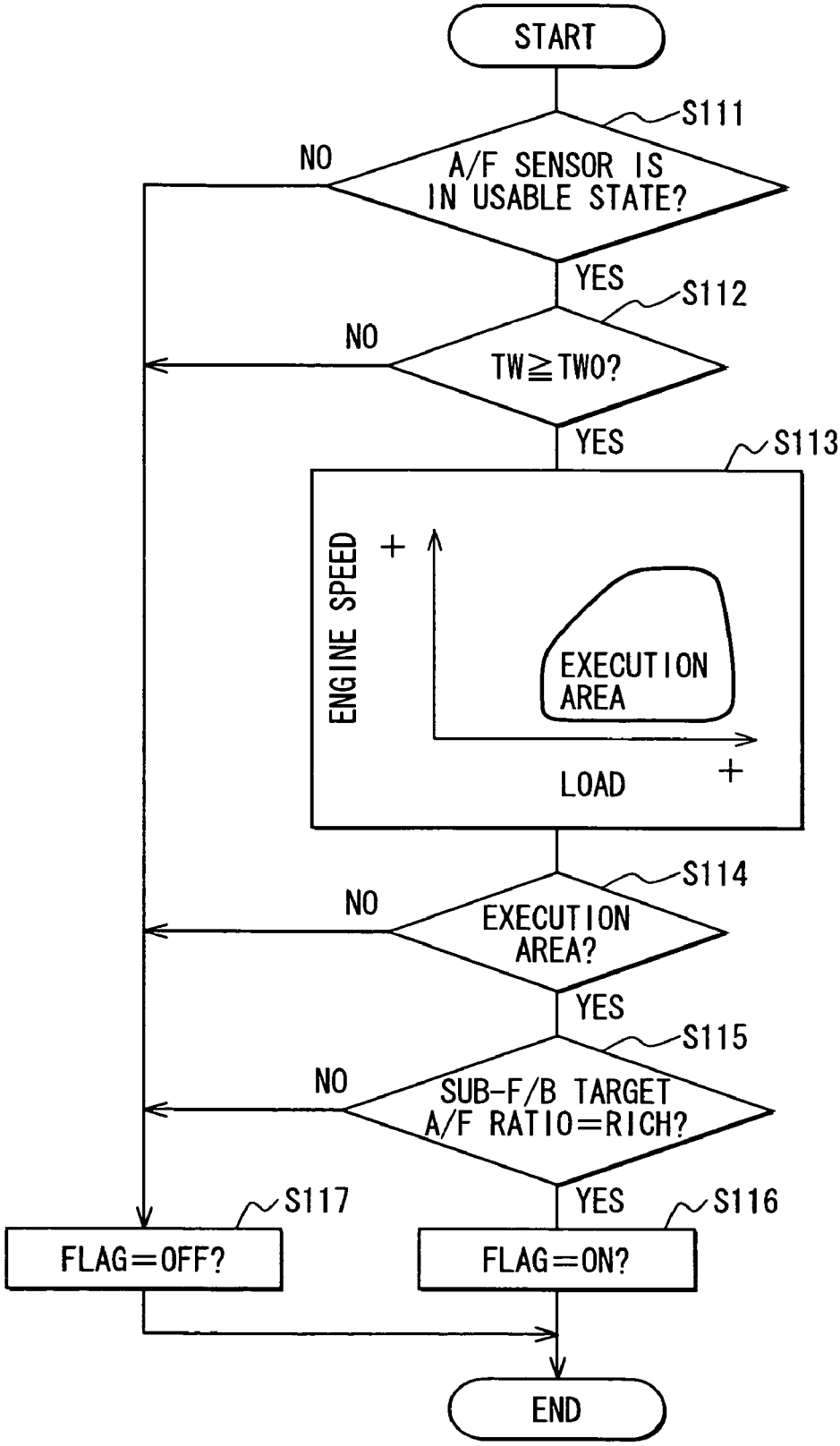
FIG. 5 is a flowchart showing an execution condition determining process.

In FIG. 4, first, at step S110, an execution condition determining process for allowing or inhibiting the cylinder-by-cylinder air-fuel ratio estimation is performed. The execution condition determining process will be described in detail with reference to FIG. 5. At step S111, whether the air-fuel ratio sensor 13 is in a usable state or not is determined. Concretely, whether or not the air-fuel ratio sensor 13 is activated, is not failed, and the like is determined. At step S112, whether or not the engine water temperature TW is a predetermined temperature TW0 (for example, 70° C.) or higher is determined. When the air-fuel ratio sensor 13 is usable and the engine water temperature is the predetermined temperature or higher, the program proceeds to step S113.

At steps S113 and S114, with reference to an operation area map using engine speed and engine load (for example, intake pipe negative pressure) as parameters, whether the present engine operating state is in an execution area or not is determined. It is considered that estimation of the cylinder-by-cylinder air-fuel ratio is difficult or the reliability of an estimated value is low in a high engine-speed area and a low load area. Thus, the execution area is set as shown in the drawing so that the cylinder-by-cylinder air-fuel ratio estimation is inhibited in such operation areas.

When the present engine operating state is in the execution area, the program advances to step S115. At step S115, whether the sub-feedback target air-fuel ratio (the target air-fuel ratio which is set on the basis of the rich/lean state of the O2 sensor output) is on the rich side or not is determined. When the sub-feedback target air-fuel ratio is on the rich side, the program advances to step S116 where an execution flag for permitting or inhibiting execution of the cylinder-by-cylinder air-fuel ratio estimation is set (ON).

In the case where the air-fuel ratio sensor 13 is unusable, in the case where the engine water temperature is less than the predetermined temperature, in the case where the engine operating state lies out of the predetermined area, or the case where the sub-feedback target air-fuel ratio is not on the rich side, the program advances to step S117 where the execution flag is cleared (OFF). After setting or clearing the execution flag, the program returns to the original routine of FIG. 4. It is also possible to determine, in addition to the above-described conditions, whether or not the fluctuation amount of the engine speed lies in a predetermined range and a fluctuation amount of the engine load lies in a predetermined range, and to set the execution flag in accordance with the determination result.

Referring again to FIG. 4, at step S120, whether the execution flag is ON or not is determined. When the execution flag is OFF, the program advances to step S130. At step S130, the sub-feedback target air-fuel ratio is set as the target air-fuel ratio. When the execution flag is ON, the program advances to step S140. At step S140, the rich target air-fuel ratio as the predetermined rich air-fuel ratio is set as the target air-fuel ratio.

After that, at step S150, a reference crank angle for performing the cylinder-by-cylinder air-fuel ratio estimation is set. Concretely, with reference to a map using the engine load (for example, the intake pipe negative pressure) as a parameter, a reference crank angle is set according to the engine load at that time. In the map, the reference crank angle is shifted to a retard side in the low load area. Specifically, since it is considered that the exhaust flow velocity is low in the low load area, the reference crank angle is set in accordance with the retard amount.

Figure 6:
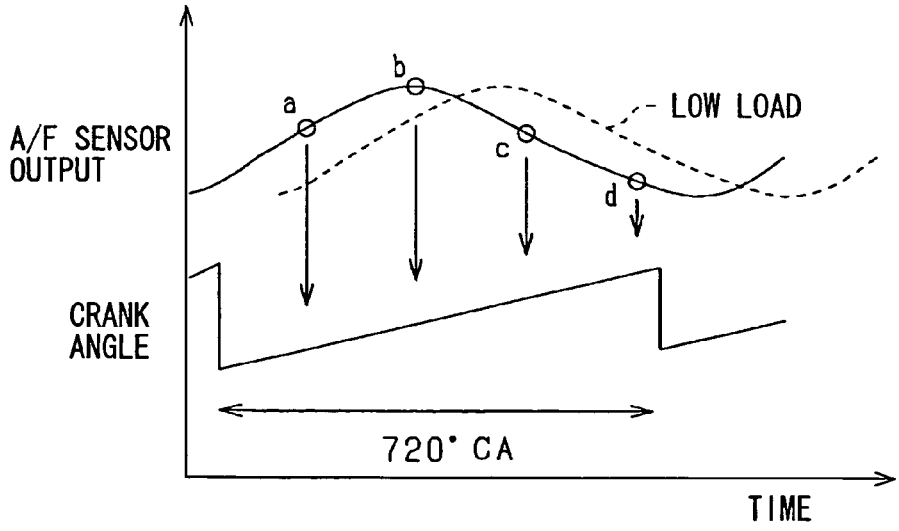
FIG. 6 is a time chart showing the relation between an Air-fuel ratio sensor value and a crank angle.

The reference crank angle indicates a reference angle position for obtaining the Air-fuel ratio sensor value used for the estimation of the cylinder-by-cylinder air-fuel ratio, and varies according to the engine load. With reference to FIG. 6, the Air-fuel ratio sensor value fluctuates according to individual differences or the like among the cylinders, and has a predetermined pattern synchronized with the crank angle. This fluctuation pattern shifts to the retard side in the case where the engine load is low. For example, in the case where the Air-fuel ratio sensor value is desired to be obtained at timings of a, b, c and d in FIG. 6, when the load fluctuation occurs, the Air-fuel ratio sensor value shifts from the originally desired value. However, when the reference crank angle is variably set as described above, the Air-fuel ratio sensor value can be acquired at the optimum timings. The acquisition (for example, A/D conversion) itself of the Air-fuel ratio sensor value is not always limited to the timing of the reference crank angle. It may be performed at intervals shorter than the reference crank angle.

After that, the program advances to step S170 on condition of the reference crank angle (YES at step S160), and the cylinder-by-cylinder air-fuel ratio is estimated. At this time, the air-fuel ratio (actual air-fuel ratio) calculated from the detection signal of the air-fuel ratio sensor 13 is read, and the cylinder-by-cylinder air-fuel ratio is estimated on the basis of the read air-fuel ratio. The method of estimating the cylinder-by-cylinder air-fuel ratio is as described before.

After completion of the estimation of the cylinder-by-cylinder air-fuel ratio, as described by referring to FIG. 1 and the like, an average value of the estimated values of the cylinder-by-cylinder air-fuel ratios for all the cylinders is calculated, and the average value is used as the base air-fuel ratio. A cylinder-by-cylinder correction amount is calculated for each cylinder according to the difference between the cylinder-by-cylinder air-fuel ratio and the base air-fuel ratio. By using the cylinder-by-cylinder correction amount, the final injection amount is corrected on the cylinder unit basis.

Figure 7:
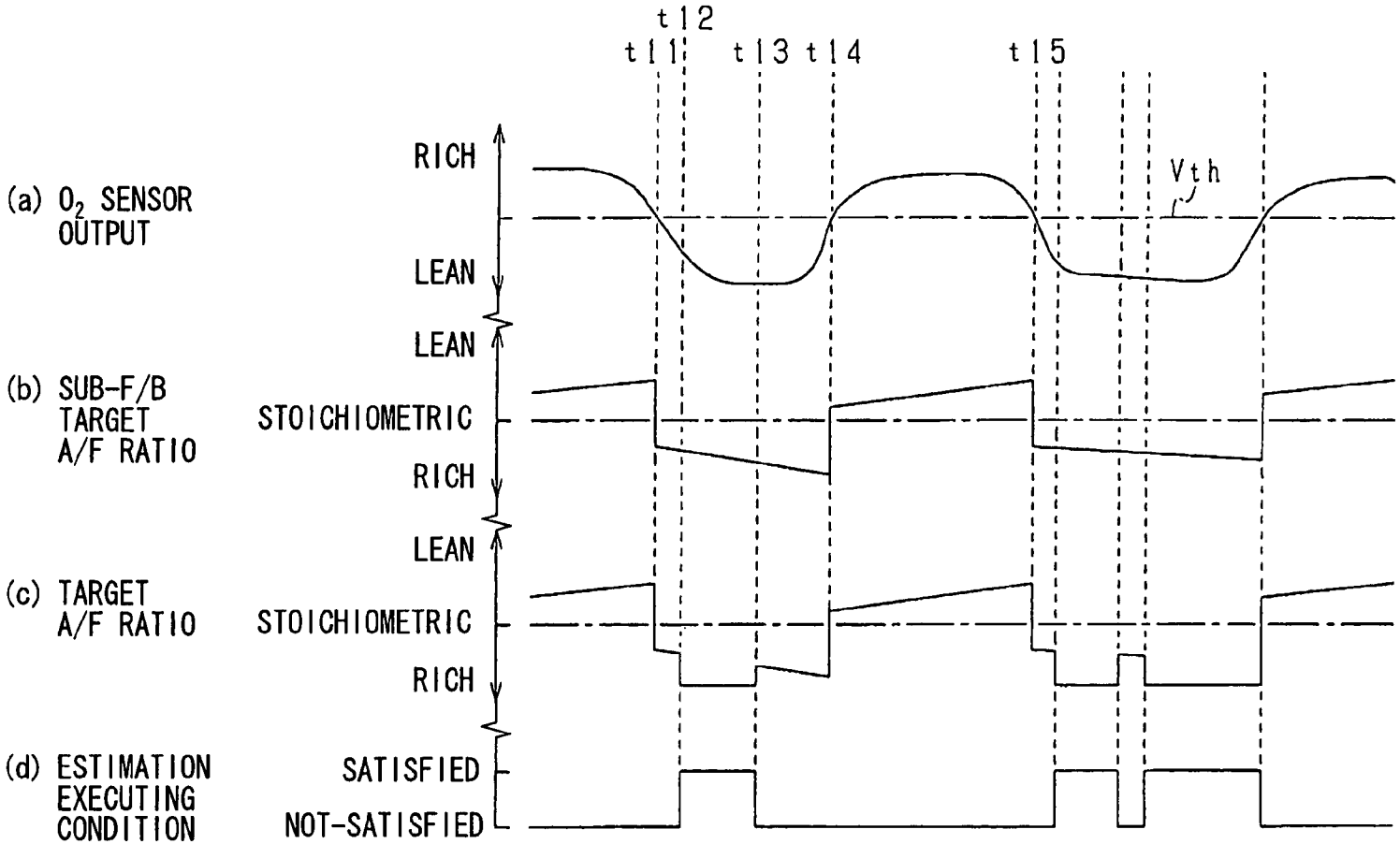
FIG. 7 is a time chart more specifically illustrating an example of cylinder-by-cylinder air-fuel ratio estimation.

FIG. 7 is a time chart for explaining the example of the cylinder-by-cylinder air-fuel ratio estimation more concretely. In FIG. 7, (a) shows the O2 sensor output, (b) shows the sub-feedback target air-fuel ratio, (c) shows the final target air-fuel ratio, and (d) indicates whether the cylinder-by-cylinder air-fuel ratio estimation executing condition is satisfied or not. As described with reference to FIG. 3, the O2 sensor output changes periodically between the rich output and the lean output. According to the change, the sub-feedback target air-fuel ratio changes between the rich side and the lean side.

In FIG. 7, at timing t11, the O2 sensor output changes to the lean output, and the sub-feedback target air-fuel ratio changes to the rich side. After that, at timing t12, the cylinder-by-cylinder air-fuel ratio estimation executing condition is satisfied. The cylinder-by-cylinder air-fuel ratio is estimated in the period from the timing t12 to the timing t13. The estimation execution condition includes that, as described above, the engine operating state is in a predetermined execution condition satisfied state, and the sub-feedback target air-fuel ratio is on the rich side. In the executing condition satisfied period (t12 to t13), the target air-fuel ratio is set to the rich side more than the sub-feedback target air-fuel ratio. In the state, the cylinder-by-cylinder air-fuel ratio is estimated. After that, when the executing condition becomes unsatisfied at timing t13, the estimation of the cylinder-by-cylinder air-fuel ratio is stopped. At timing t14, the O2 sensor output changes to the rich output and, accordingly, the sub-feedback target air-fuel ratio shifts to the lean side.

After that, at timing t15, the O2 sensor output changes again to the lean output, and the sub-feedback target air-fuel ratio shifts to the rich side. After the timing t15, in a manner similar to the above, the target air-fuel ratio is shifted to the rich side in the period in which the cylinder-by-cylinder air-fuel ratio estimation executing condition is satisfied, and the cylinder-by-cylinder air-fuel ratio is estimated in the state.

In the state where the target air-fuel ratio is set to the rich side, rich gas is detected by the air-fuel ratio sensor 13. At this time, even if the response of the air-fuel ratio sensor 13 is low, the cylinder-by-cylinder air-fuel ratio is estimated by using only the rich output of relatively high response. Therefore, decrease in the calculation precision of the cylinder-by-cylinder air-fuel ratio is suppressed.

According to the embodiment described above in detail, the following excellent effects can be obtained.

Since execution of calculation of the cylinder-by-cylinder air-fuel ratio is permitted when it is determined that the sub-feedback target air-fuel ratio is on the rich side, even if output response on the lean side of the air-fuel ratio sensor 13 decreases, the cylinder-by-cylinder air-fuel ratio can be excellently calculated while making variations among the cylinders reflected. Therefore, the air-fuel ratio control can be performed with high precision on the basis of the cylinder-by-cylinder air-fuel ratio. Also in the case of using the air-fuel ratio sensor 13 whose response is deteriorating, by using the rich-side sensor output having relatively high response, the cylinder-by-cylinder air-fuel ratio can be calculated excellently.

In the case of the embodiment, if at least the sensor response on the rich side is assured, the cylinder-by-cylinder air-fuel ratio can be calculated excellently. As a result, the number of Air-fuel ratio sensors 13 discarded as nonconforming ones can be reduced. Therefore, the cost can be also reduced.

Fluctuations of the O2 sensor output on the catalyst downstream side are relatively gentle, and the sub-feedback target air-fuel ratio which is set on the basis of the O2 sensor output fluctuates gently between the rich and lean sides. Therefore, the cylinder-by-cylinder air-fuel ratio can be more excellently calculated when whether calculation of the cylinder-by-cylinder air-fuel ratio can be executed or not is determined using the sub-feedback target air-fuel ratio as a determination parameter as compared with the case where whether calculation of the cylinder-by-cylinder air-fuel ratio can be executed or not is determined using the output (detected air-fuel ratio) of the air-fuel ratio sensor 13 as a determination parameter.

At the time of calculating the cylinder-by-cylinder air-fuel ratio, the target air-fuel ratio is set to the rich side than the sub-feedback target air-fuel ratio. Therefore, the gas atmosphere of the air-fuel ratio sensor 13 can be set to the rich state more reliably. That is, the output of the air-fuel ratio sensor 13 can be held rich in the period of calculating the cylinder-by-cylinder air-fuel ratio. Since the output is inherently to be on the rich side in this period, even when the target air-fuel ratio is set to be richer, no adverse influence on exhaust emission is expected.

Since the cylinder-by-cylinder air-fuel ratio is estimated using the model constructed on the basis of the gas inflow and mixture in the exhaust collective part 12*b*, the cylinder-by-cylinder air-fuel ratio can be calculated while reflecting the gas exchange behavior of the exhaust collective part 12*b*. Since the model is a model (autoregressive model) of predicting the detection value of the air-fuel ratio sensor 13 from the past values, different from the conventional structure using finite combustion histories (combustion air-fuel ratios), it is not necessary to increase the histories in order to improve the accuracy. Consequently, the complication of modeling is eliminated by using the simple model and, moreover, the cylinder-by-cylinder air-fuel ratio can be calculated with high accuracy. As a result, the controllability of the air-fuel ratio control improves.

Since the Kalman filter type observer is used for the estimation of the cylinder-by-cylinder air-fuel ratio, the performance of noise resistance improves, and the estimation accuracy of the cylinder-by-cylinder air-fuel ratio improves.

In the air-fuel ratio feedback control, the cylinder-by-cylinder air-fuel ratio deviation as an air-fuel ratio variation amount among the cylinders is calculated on the basis of the cylinder-by-cylinder air-fuel ratio (estimated value), and the cylinder-by-cylinder correction amount is calculated by cylinder in accordance with the calculated cylinder-by-cylinder air-fuel ratio deviation. Thus, an error in air-fuel ratio control due to the variation amount of the air-fuel ratios of the cylinders can be decreased, and the air-fuel ratio control with high accuracy can be realized.

In calculation of the cylinder-by-cylinder correction amount, the average value of the cylinder-by-cylinder correction amounts of all the cylinders is calculated and is subtracted from the cylinder-by-cylinder correction amount for each cylinder. Thus, interference with the normal air-fuel ratio feedback control can be avoided. Specifically, in the normal air-fuel ratio feedback control, the air-fuel ratio control is performed so that the air-fuel ratio detection value in the exhaust collective part 12*b* coincides with the target value. In contrast, in the cylinder-by-cylinder air-fuel ratio control, the air-fuel ratio control is performed so that the variations in air-fuel ratios among the cylinders are absorbed.

Second Embodiment

Next, a second embodiment will be described mainly with respect to the points different from the foregoing first embodiment. In the second embodiment, at the time of calculating the cylinder-by-cylinder air-fuel ratio, the response of the air-fuel ratio sensor 13 is detected and, on the basis of the detection result, the target air-fuel ratio is set.

Figure 8:
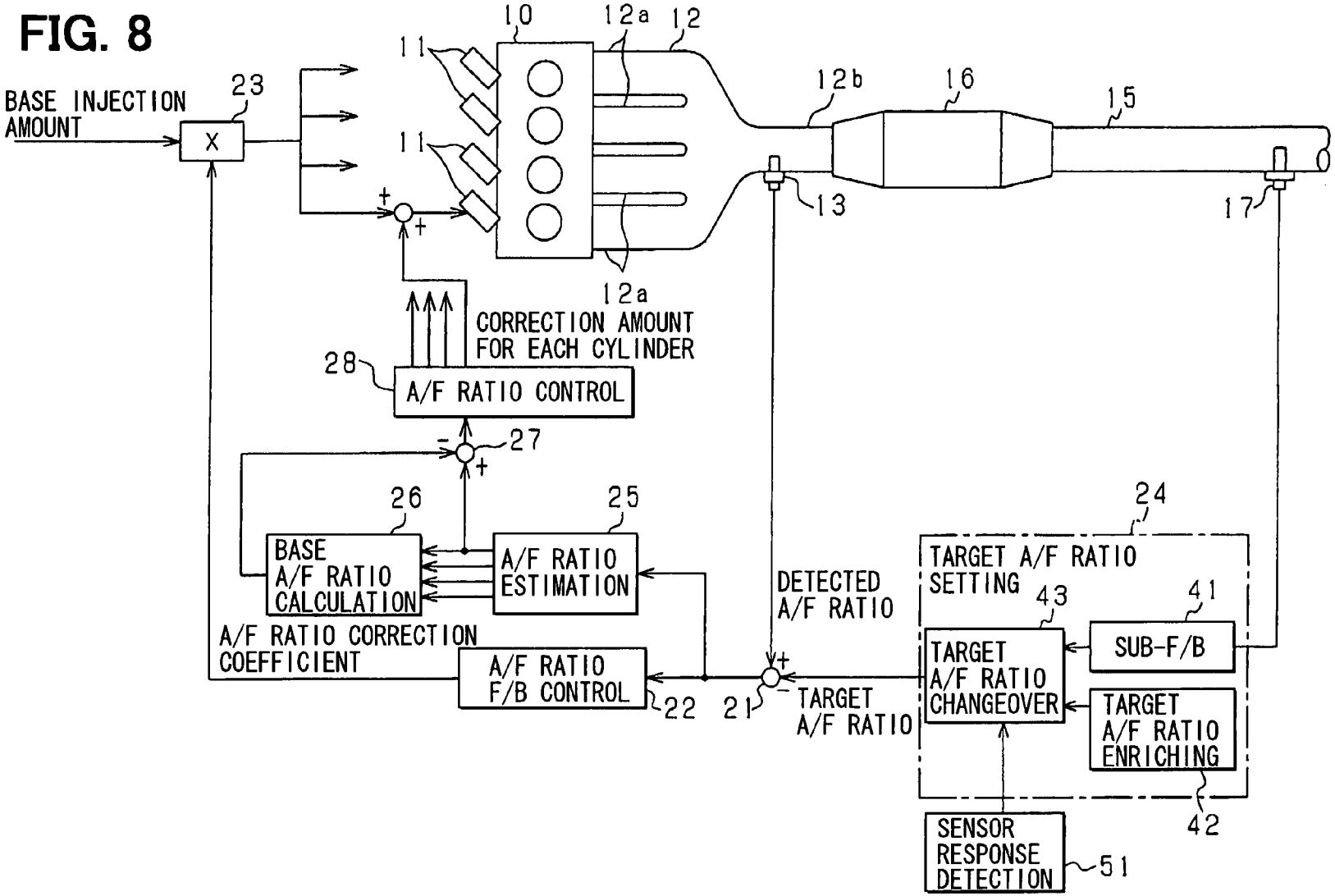
FIG. 8 is a configuration diagram showing an outline of an engine control system according to a second embodiment.

FIG. 8 is a diagram showing an outline of an engine control system in the second embodiment. In FIG. 8, as the point different from FIG. 1, a sensor response detection part 51 is provided, and the response of the air-fuel ratio sensor 13 is detected by the sensor response detection part 51. In the sensor response detection part 51, lapse time (response time) until a predetermined response change appears when the target air-fuel ratio is changed step by step is measured and, on the basis of the lapse time, whether the sensor response is fast or slow is determined. The target air-fuel ratio changeover part 43 changes the target air-fuel ratio on the basis of the detection result of the sensor response detection part 51.

Figure 9:
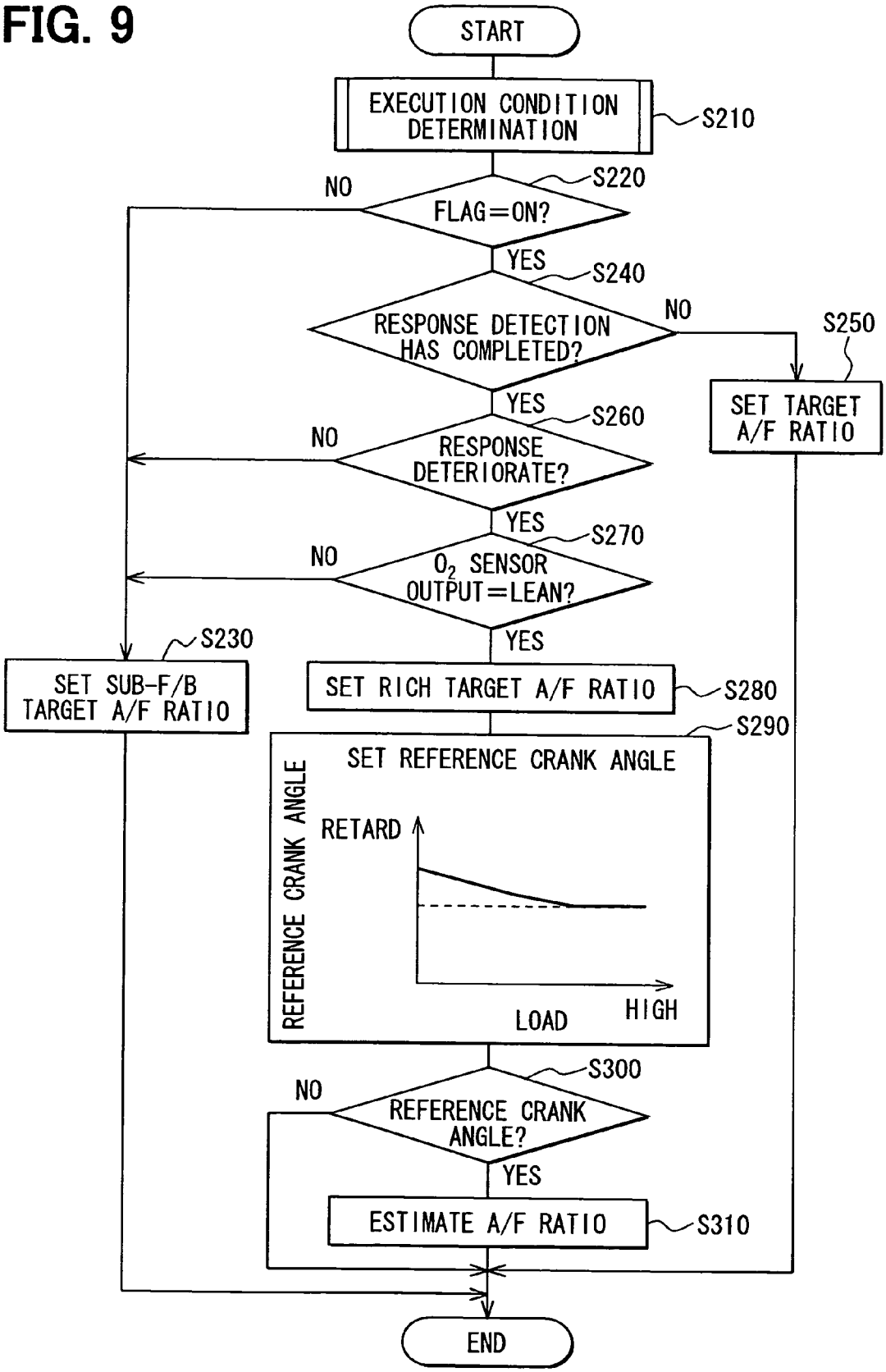
FIG. 9 is a flowchart showing a cylinder-by-cylinder air-fuel ratio estimating process in the second embodiment.

FIG. 9 is a flowchart showing a cylinder-by-cylinder air-fuel ratio estimating process in the second embodiment, and the process is performed instead of the process of FIG. 4 by the engine ECU.

Figure 10:
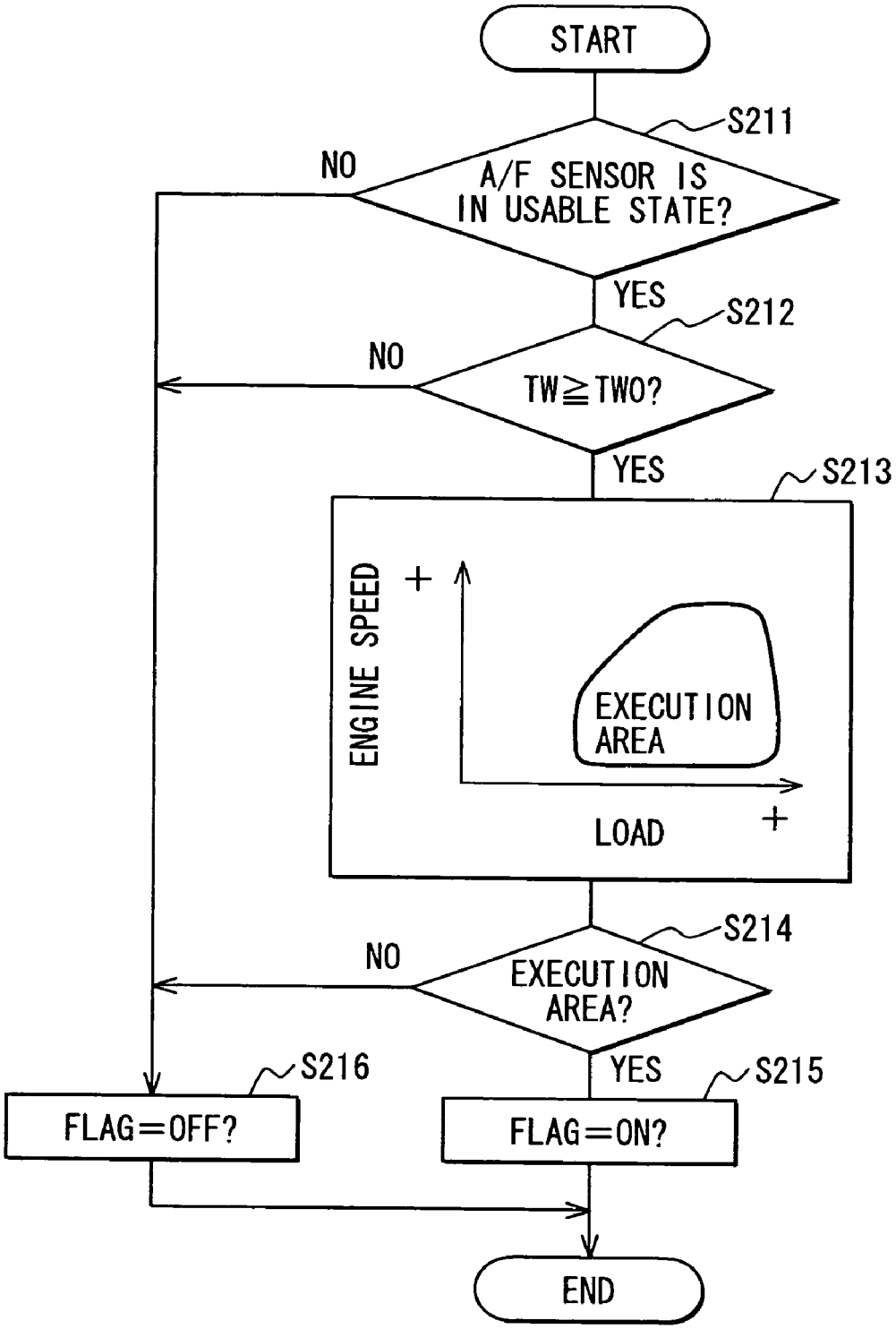
FIG. 10 is a flowchart showing an execution condition determining process in the second embodiment.

In FIG. 9, first, at step S210, an execution condition determining process for permitting/inhibiting the cylinder-by-cylinder air-fuel ratio estimation is performed. The execution condition determining process will be described with reference to FIG. 10. The processes at steps S211 to S214 in FIG. 10 are similar to those at steps S111 to S114 in FIG. 5. Specifically, at step S211, whether the air-fuel ratio sensor 13 is in a usable state or not is determined (whether or not the air-fuel ratio sensor 13 is activated, is not failed, and the like is determined). At step S212, whether or not the engine water temperature TW is a predetermined temperature TW0 (for example, 70° C.) or higher is determined. At steps S213 and S214, with reference to an operation area map using engine speed and engine load (for example, intake pipe negative pressure) as parameters, whether the present engine operating state is in an execution area or not is determined.

When all of the conditions such that the air-fuel ratio sensor 13 is in the usable state, engine warm-up has performed, and the engine operating state is in the execution area are satisfied, the program advances to step S215. At step S215, an execution flag for permitting or inhibiting execution of the cylinder-by-cylinder air-fuel ratio estimation is set (ON). In the case where any of the conditions is not satisfied, the program advances to step S216 where the execution flag is cleared (OFF). After setting or clearing the execution flag, the program returns to the original routine of FIG. 9.

Referring again to FIG. 9, at step S220, whether the execution flag is ON or not is determined. When the execution flag is OFF, the program advances to step S230. At step S230, the sub-feedback target air-fuel ratio is set as the target air-fuel ratio.

When the execution flag is ON, the program advances to step S240. At step S240, whether response detection of the air-fuel ratio sensor 13 has completed or not is determined. In the case where the sensor response detection has not completed, the program advances to step S250 where a target air-fuel ratio for response detection is set to perform a sensor response detecting process. The target air-fuel ratio for response detection is set on the basis of a predetermined air-fuel ratio setting pattern, and is changed in order of, for example, rich air-fuel ratio, weak lean air-fuel ratio, and strong lean air-fuel ratio.

In the case where the sensor response detection has completed, the program advances to step S260. At step S260, whether the response of the air-fuel ratio sensor 13 has deteriorated or not is determined on the basis of the result of the sensor response detection. In the case where the response of the air-fuel ratio sensor 13 has not decreased, the program advances to step S230 where the sub-feedback target air-fuel ratio is set as a target air-fuel ratio. When the response of the air-fuel ratio sensor 13 has decreased, the program advances to step S270 and whether the present O2 sensor output is a lean output or not is determined. When the O2 sensor output is a rich output, the program advances to step S230 where the sub-feedback target air-fuel ratio is set as a target air-fuel ratio.

That is, when the response of the air-fuel ratio sensor 13 has not decreased, the cylinder-by-cylinder air-fuel ratio can be excellently calculated irrespective of the sensor output (rich or lean), the target air-fuel ratio is not set to the rich side. When the O2 sensor output is a rich output, the target air-fuel ratio is not set to the rich side to prevent the exhaust emission from deteriorating.

When the O2 sensor output is a lean output, the program advances to step S280 where the rich target air-fuel ratio as the predetermined rich air-fuel ratio is set as the target air-fuel ratio. In this case, the rich target air-fuel ratio is an air-fuel ratio value which is richer than the stoichiometric air-fuel ratio by 2% to 3%.

After that, at step S290, a reference crank angle for estimating the cylinder-by-cylinder air-fuel ratio is set (in a manner similar to step S150 in FIG. 4). On condition that the reference crank angle is set (YES at step S300), the program advances to step S310 where the cylinder-by-cylinder air-fuel ratio is estimated. At this time, the air-fuel ratio (actual air-fuel ratio) calculated from the detection signal of the air-fuel ratio sensor 13 is read and, on the basis of the read air-fuel ratio, the cylinder-by-cylinder air-fuel ratio is estimated. The method of estimating the cylinder-by-cylinder air-fuel ratio is as described above.

Figure 11:
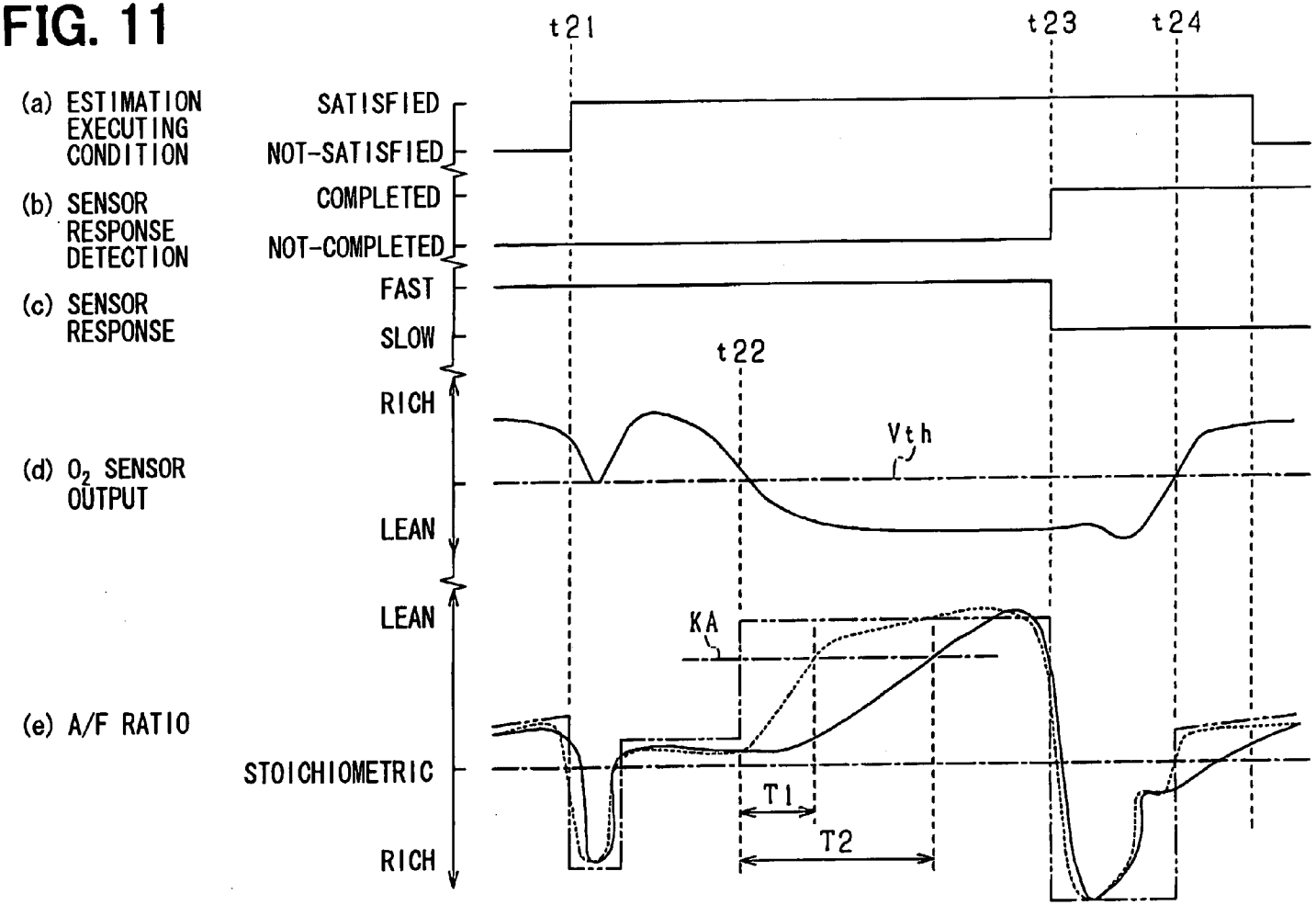
FIG. 11 is a time chart for more specifically showing an example of cylinder-by-cylinder air-fuel ratio estimation in the second embodiment.

FIG. 11 is a time chart for explaining the example of the cylinder-by-cylinder air-fuel ratio estimation in the second embodiment more concretely. In FIG. 11, (a) shows whether the cylinder-by-cylinder air-fuel ratio estimation executing condition is satisfied or not, (b) shows an execution state of the sensor response detecting process, (c) shows a sensor response detection result, (d) indicates an O2 sensor output, and (e) indicates the behavior of the air-fuel ratio. FIG. 11 shows the control operation in the case where the response of the air-fuel ratio sensor 13 decreases. As the behavior of the air-fuel ratio of (e), transition of the target air-fuel ratio is shown by the alternate long and two short dashes line, and transition of the air-fuel ratio detected by the Air-fuel ratio sensor whose response has decreased is shown by the solid line. For comparison, transition of the air-fuel ratio detected by the Air-fuel ratio sensor whose response has not decreased is shown by the dot line. The response of the lean output is lower than that of the originally rich output. Particularly, in the embodiment, only the response of the lean output is assumed to be lower.

In FIG. 11, at timing t21, the cylinder-by-cylinder air-fuel ratio estimation executing condition is satisfied. Since the response detection of the air-fuel ratio sensor 13 has not completed at that time point, the sensor response detecting process is executed. The period from the timing t21 to the timing t23 is the period of execution of the sensor response detecting process, and the target air-fuel ratio is set by the predetermined setting pattern in the period. At the timing t21 and after that, the target air-fuel ratio is changed in order of the rich air-fuel ratio, weak lean air-fuel ratio, and strong lean air-fuel ratio. By using, as a start point, the timing t22 at which the target air-fuel ratio is changed from the weak lean air-fuel ratio to the strong lean air-fuel ratio step by step, response time until the air-fuel ratio detected by the air-fuel ratio sensor 13 reaches a predetermined response determination level (KA in FIG. 11) is measured, and whether the sensor response is fast or slow is determined on the basis of the measurement result. In the example of FIG. 11, in the case of the Air-fuel ratio sensor whose response has not decreased, the response time is T1. On the other hand, in the case of the Air-fuel ratio sensor whose response has decreased, the response time is T2.

At timing t23, the sensor response detecting process completes and it is determined that the sensor response is slow at that time point. At the timing t23, the O2 sensor output is a lean output. Consequently, the target air-fuel ratio is changed to the rich target air-fuel ratio. In the period from the timing t23 to the timing t24, the cylinder-by-cylinder air-fuel ratio is estimated.

According to the second embodiment described above in detail, at the time of calculating the cylinder-by-cylinder air-fuel ratio, when it is determined that the response of the air-fuel ratio sensor 13 has decreased, the target air-fuel ratio is set to the rich side. Specifically, in the case of the Air-fuel ratio sensor whose response has decreased, detection accuracy cannot be assured by a lean output but can be assured by a rich output. In such a case, even when the detection accuracy of the lean air-fuel ratio decreases in association with the decrease in the sensor response, by setting the target air-fuel ratio to the rich side to make the Air-fuel ratio sensor output rich and using the rich output, the cylinder-by-cylinder air-fuel ratio can be calculated excellently.

When the O2 sensor output becomes a rich output, the operation of making the target air-fuel ratio rich is stopped. Therefore, the exhaust emission can be prevented from deteriorating.

The present invention is not limited to the foregoing embodiments but may be carried out as follows.

In the foregoing embodiments, the target air-fuel ratio changeover part 43 (refer to FIG. 1) in the target air-fuel ratio setting part 24 changes alternatively between the sub-feedback target air-fuel ratio set by the sub-feedback part 41 and the rich target air-fuel ratio set by the target air-fuel ratio enriching part 42 on the basis of the cylinder-by-cylinder air-fuel ratio estimation executing condition. This configuration may be changed. For example, a target air-fuel ratio correction part for correcting the sub-feedback target air-fuel ratio set by the sub-feedback part 41 to the rich side on the basis of the cylinder-by-cylinder air-fuel ratio estimation executing condition is provided, and the target air-fuel ratio is set to the rich side by the correction part.

In the first embodiment, the sub-feedback control is employed as the air-fuel ratio control method and whether the sub-feedback target air-fuel ratio is rich or not is determined. In the case where the sub-feedback target air-fuel ratio is rich, the cylinder-by-cylinder air-fuel ratio is calculated. The configuration may be changed to a configuration in which the sub-feedback control is not executed. The target air-fuel ratio is set according to the engine operating state and whether the target air-fuel ratio is rich or not is determined. When the target air-fuel ratio is rich, the cylinder-by-cylinder air-fuel ratio is calculated. As compared with the case of determining whether calculation of the cylinder-by-cylinder air-fuel ratio can be executed or not by using the actual air-fuel ratio (air-fuel ratio sensor output) as a determination parameter, in the case of determining whether the calculation of the cylinder-by-cylinder air-fuel ratio can be executed or not by using the target air-fuel ratio as a determination parameter, the cylinder-by-cylinder air-fuel ratio can be calculated more excellently.

In the configuration where the sub-feedback control is not executed, when it is determined that the response of the air-fuel ratio sensor 13 decreases, preferably, the target air-fuel ratio is set to the rich side and, in the state, the calculation of the cylinder-by-cylinder air-fuel ratio is executed. In such a case, even when the accuracy of detection of the lean air-fuel ratio decreases as the sensor response decreases, the cylinder-by-cylinder air-fuel ratio can be excellently calculated by a sensor rich output having relatively high response.

In the second embodiment, as the method of detecting the response of the air-fuel ratio sensor 13, the response time of the sensor output when the target air-fuel ratio changes step by step is measured and, on the basis of the response time, whether the response is fast or slow is determined. The method may be changed to another method. For example, whether the response is fast or slow may be determined on the basis of an air-fuel ratio correction factor (FAF) when the target air-fuel ratio changes step by step.

The response on the rich side and the response on the lean side of the air-fuel ratio sensor 13 are detected. When it is determined the sensor response has decreased on the rich or lean side, the calculation of the cylinder-by-cylinder air-fuel ratio may be executed by using a sensor output on the side where the response has not decreased. For example, as a result of the response detection, when the response on the lean side has decreased, the cylinder-by-cylinder air-fuel ratio is calculated by using the rich output of the air-fuel ratio sensor 13. On the contrary, when the response on the rich side has decreased, the cylinder-by-cylinder air-fuel ratio is calculated by using the lean output of the air-fuel ratio sensor 13. In this case, even when the response of the rich or lean output of the air-fuel ratio sensor 13 decreases, the calculation of the cylinder-by-cylinder air-fuel ratio can be executed by using only the sensor output having high response.

It is also possible to determine which one of the rich output and the lean output of the air-fuel ratio sensor 13 has higher response and execute the calculation of the cylinder-by-cylinder air-fuel ratio by using the sensor output having higher response. It is sufficient to detect the sensor response on the basis of response time when the target air-fuel ratio is changed to the rich side and the lean side by a predetermined pattern. Even if the response on the rich or lean side decreases due to the individual difference of the Air-fuel ratio sensor, change with time, and the like, the invention can address the decrease excellently.

Te cylinder-by-cylinder air-fuel ratio calculating method is not limited to the above method but may be varied.

Data on the cylinder-by-cylinder air-fuel ratio may be stored as an adaptation value into a backup memory such as an EEPROM.

Although the fuel injection amount is controlled on the basis of the cylinder-by-cylinder air-fuel ratio estimation value in the foregoing embodiment, in place of the fuel injection amount, an intake air amount may be controlled. In any case, it is sufficient if the air-fuel ratio is feedback-controlled with high accuracy.

The system in the foregoing embodiment has the whole-area air-fuel ratio sensor (linear Air-fuel ratio sensor) on the upstream side of the three-way catalyst and the oxygen concentration sensor (the O2 sensor of the electromotive output type) on the downstream side of the three-way catalyst. The configuration may be changed to a configuration where the whole-area air-fuel ratio sensor is provided on each of the upstream and downstream sides of the three-way catalyst.

As long as the multi-cylinder internal combustion engine has the structure in which exhaust passages are collected by plural cylinders, the invention can be applied to any type of engine. For example, in a 6-cylinder engine, in the case where two exhaust systems each having three cylinders are constructed, an air-fuel ratio sensor is disposed at the collective part of each of the exhaust systems, and the cylinder-by-cylinder air-fuel ratio is calculated in each of the exhaust systems as described above.

Third Embodiment

Figure 12:
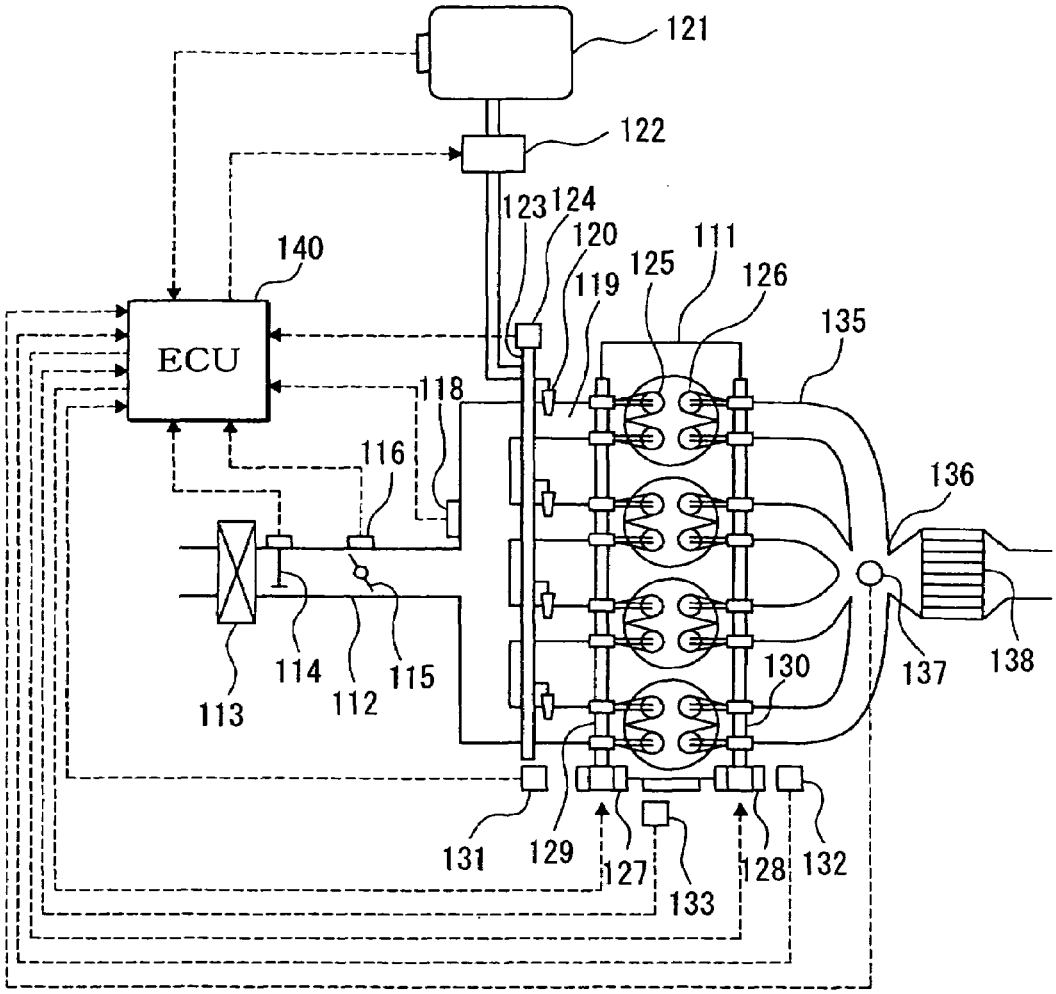
FIG. 12 is a configuration diagram schematically showing an engine control system in a third embodiment.

A third embodiment of the invention will be described with reference to FIGS. 12 to 18. Referring first to FIG. 12, a schematic configuration of a whole engine control system will be described. An air cleaner 113 is provided at the most upstream position of an intake pipe 112 of an in-line four-cylinder engine 111 as an internal combustion engine. An air flow meter 114 for detecting an intake air volume is provided downstream of the air cleaner 113. A throttle valve 115 whose opening is adjusted by a motor or the like and a throttle opening sensor 116 for detecting a throttle opening are provided downstream of the air flow meter 114.

Further, a surge tank 117 is provided downstream of the throttle valve 115. The surge tank 17 is provided with an intake manifold pressure sensor 118 for detecting an intake manifold pressure. The surge tank 17 is also provided with an intake manifold 119 for introducing air into the cylinders of the engine 111. A fuel injection valve 120 for injecting fuel is mounted near the intake port of the intake manifold 119 of each cylinder. During engine operation, fuel in a fuel tank 121 is sent to a delivery pipe 123 by a fuel pump 122, and the fuel is injected from the fuel injection valve 120 of each cylinder at each injection timing of the cylinder. A fuel pressure sensor 124 for detecting fuel pressure is attached to the delivery pipe 123.

The engine 111 is provided with variable valve timing mechanisms 127 and 128 for varying the opening/closing timings of an intake valve 125 and an exhaust valve 126, respectively. The engine 111 is also provided with an inlet cam angle sensor 131 and an exhaust cam angle sensor 132 for outputting cam angle signals synchronously with the rotation of an inlet camshaft 129 and an exhaust camshaft 130. The engine 111 is also provided with a crank angle sensor 133 for outputting a pulse of a crank angle signal every predetermined crank angle (for example, every 30° CA) synchronously with rotation of the crankshaft of the engine 111.

On the other hand, in an exhaust collective part 136 in which exhaust manifolds 136 of the cylinders of the engine 111 are collected, an air-fuel ratio sensor 137 for detecting the air-fuel ratio of an exhaust gas is mounted. A catalyst 138 such as a three-way catalyst for reducing CO, HC, NOx, and the like in the exhaust gas is provided downstream of the air-fuel ratio sensor 137.

Outputs of the various sensors such as the air-fuel ratio sensor 137 are inputted to an engine control unit (ECU) 140. The ECU 140 is mainly constructed of a microcomputer and executes various engine control programs that are stored in a built-in ROM (storage medium), thereby controlling a fuel injection amount and ignition timing of the fuel injection valves 120 of the cylinders in accordance with the engine operating state.

In the third embodiment, by executing routines of cylinder-by-cylinder air-fuel ratio control shown in FIGS. 15 to 18 to be described later, the ECU 140 estimates the air-fuel ratio of each of the cylinders on the basis of a detection value of the air-fuel ratio sensor 137 (an actual air-fuel ratio of the exhaust gas flowing in the exhaust collective part 136) by using a cylinder-by-cylinder air-fuel ratio estimation model which will be described later, and calculates an average value of estimated air-fuel ratios of all of the cylinders, sets the average value as the base air-fuel ratio (the target air-fuel ratio of all of the cylinders). The ECU 140 calculates the deviation between the estimated air-fuel ratio of each cylinder and the base air-fuel ratio cylinder by cylinder, calculates the fuel correction amount of each cylinder (a correction amount for the fuel injection amount) so as to reduce the deviation and, on the basis of the calculation result, corrects the fuel injection amount of each cylinder. In such a manner, the ECU 140 performs the control so as to reduce the air-fuel ratio variations among the cylinders by correcting the air-fuel ratio of the air-fuel mixture supplied to the cylinders on the cylinder unit basis.

A concrete example of a model of estimating an air-fuel ratio of each cylinder (hereinbelow, called "cylinder-by-cylinder air-fuel ratio estimation model") on the basis of a detection value of the air-fuel ratio sensor 137 (the actual air-fuel ratio of the exhaust gas flowing in the exhaust collective part 136) will be described.

By paying attention to gas exchange in the exhaust collective part 136, the detection value of the air-fuel ratio sensor 137 is modeled by multiplying the history of the estimated air-fuel ratio of each cylinders in the exhaust collective part 136 and the history of the detection value of the air-fuel ratio sensor 137 with specified weights and by adding the resultant values. By using the model, the air-fuel ratio of each cylinder is estimated. A Kalman filter is used as an observer.

More specifically, the model of the gas exchange in the exhaust collective part 136 is approximated by the following expression (4).

$$ys(t)=k1\times u(t-1)+k2\times u(t-2)-k3\times ys(t-1)-k4\times ys(t-2) \quad (4)$$

where ys denotes the detection value of the air-fuel ratio sensor 137, u denotes the air-fuel ratio of gas flowing in the exhaust collective part 136, and k1 to k4 indicate constants.

In the exhaust system, there are a first order lag element of the gas inflow and mixture in the exhaust collective part 136 and a first order lag element due to response delay of the air-fuel ratio sensor 137. In the expression (4), in consideration of the first order lag elements, the past two histories are referred to.

When the expression (4) is converted into a state space model, the following expressions (5a) and (5b) are derived.

$$X(t+1)=A\cdot X(t)+B\cdot u(t)+W(t) \quad (5a)$$

$$Y(t)=C\cdot X(t)+D\cdot u(t) \quad (5b)$$

where A, B, C and D denote parameters of the model, Y denotes the detection value of the A/F ratio sensor 137, X denotes an estimated air-fuel ratio of each cylinder as a state variable, and W denotes noise.

Further, when a Kalman filter is designed by the expressions (5a) and (5b), the following expression (6) is obtained.

$$\hat{X}(k+1|k)=A\cdot\hat{X}(k|k-1)+K\{Y(k)-C\cdot A\cdot\hat{X}(k|k-1)\} \quad (6)$$

where X^ (X hat) denotes an estimated air-fuel ratio of each cylinder, and K denotes Kalman gain. The notation of X^(k+1|k) expresses that an estimated value at the following time (k+1) is obtained based on an estimated value at time (k).

By constructing the cylinder-by-cylinder air-fuel ratio estimation model by the Kalman filter type observer as described above, the cylinder-by-cylinder air-fuel ratio can be sequentially estimated as the combustion cycle proceeds.

A method of setting the air-fuel ratio detection timing of each cylinder (sampling timing of the output of the air-fuel ratio sensor 137) will now be described. In the third embodiment, considering that a delay since an exhaust gas exhausted from each cylinder reaches around the air-fuel ratio sensor 137 until the air-fuel ratio of the exhaust gas is detected (hereinbelow, called "response delay of the exhaust system") changes according to the engine operating state, an air-fuel ratio detection reference timing of each cylinder is set by a map or the like in accordance with the engine operating state (such as engine load and engine speed). Generally, as the engine load or engine speed decreases, the response delay of the exhaust system increases. Consequently, the air-fuel ratio detection reference timing of each cylinder is set so as to be shifted to the retard side as the engine load or engine speed decreases. The air-fuel ratio detection reference timing corresponds to a proper air-fuel ratio detection timing when the target air-fuel ratio is the stoichiometric air-fuel ratio (excess air ratio $\lambda=1.0$).

Figure 13:
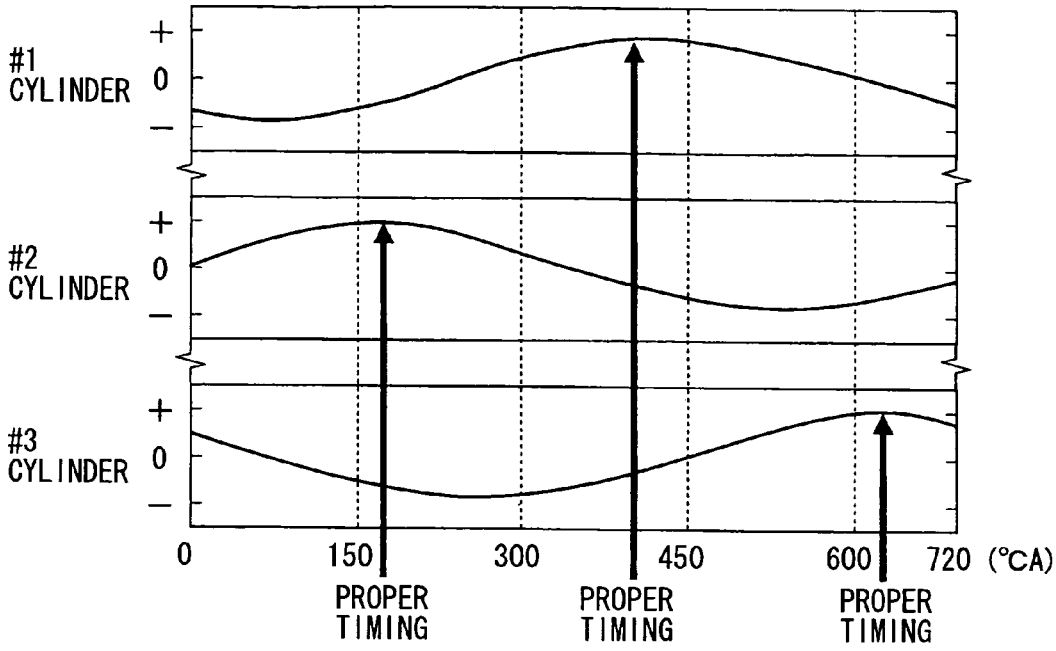
FIG. 13 is a time chart showing an example of the behavior of the output amplitude of an air-fuel ratio sensor when only one cylinder is in a rich state.
Figure 14:
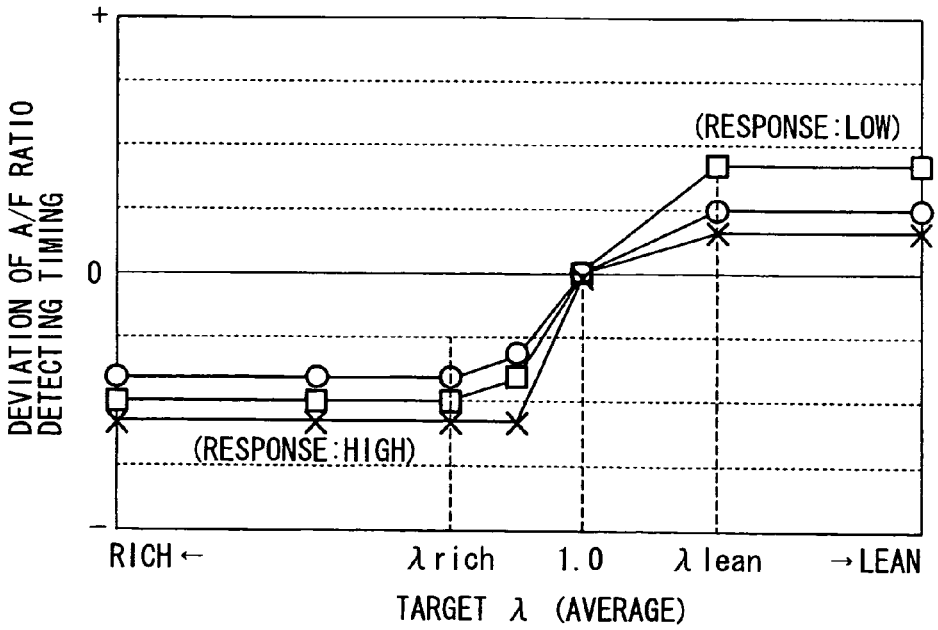
FIG. 14 is an air-fuel ratio sensor characteristic diagram showing the relation between a target air-fuel ratio (target λ) and a deviation from a proper value of an air-fuel ratio detection timing.

FIG. 13 is a time chart showing an example of the behavior of the output amplitude of the air-fuel ratio sensor 137 when only one cylinder is in the rich state. In this case, a proper air-fuel ratio detection timing is a timing when the output amplitude of the air-fuel ratio sensor 137 is at the peak. The relation between the air-fuel ratio and a deviation from the proper value of the air-fuel ratio detection timing was examined by experiments. As a result, it was found that, as shown in FIG. 14, the deviation from the proper value of the air-fuel ratio detection timing changes in a Z shape in accordance with the air-fuel ratio. Specifically, when the air-fuel ratio is the stoichiometric air-fuel ratio ($\lambda=1.0$), the deviation from the proper value of the air-fuel ratio detection timing is 0. In areas where the air-fuel ratio is relatively close to the stoichiometric air-fuel ratio, as the air-fuel ratio becomes leaner, a deviation occurs in the direction where the proper value of the air-fuel ratio detection timing retards (the response of the air-fuel ratio sensor becomes slower). As the air-fuel ratio becomes richer, a deviation occurs in the direction where the proper value of the air-fuel ratio detection timing advances (the response of the air-fuel ratio sensor becomes faster). However, in areas where the air-fuel ratio is apart from the stoichiometric air-fuel ratio to a certain extent, even when the air-fuel ratio changes to the rich/lean side, the amount of deviation from the proper value of the air-fuel ratio detecting timing (response of the air-fuel ratio sensor) hardly changes.

In consideration of change characteristics of the deviation of the air-fuel ratio detection timing according to the air-fuel ratio, in the third embodiment, for example, the relation between the air-fuel ratio and a deviation (correction amount) from the proper value of the air-fuel ratio detection timing is measured in a conforming process. On the basis of the measurement result, a table of deviations (correction amounts) from the proper value of the air-fuel ratio detection timing using the air-fuel ratio as a parameter is created, and stored in a nonvolatile memory such as a ROM in the ECU 140. With reference to the table in the engine operation, the correction amount of the air-fuel ratio detection timing according to the target air-fuel ratio or the detected air-fuel ratio is set. The correction amount of the air-fuel ratio detection timing becomes a negative value (correction in the direction of advancing the air-fuel ratio detection timing) at an air-fuel ratio on the rich side, and it becomes a positive value (correction in the direction of retarding the air-fuel ratio detection timing) at an air-fuel ratio on the lean side.

In this case, in the table of the correction amounts for the air-fuel ratio detection timing, correction amounts may be finely set at the respective air-fuel ratios in all of the air-fuel ratio areas. As shown in FIG. 14, the deviation (correction amount) from the proper value of the air-fuel ratio detection timing changes in the Z shape in accordance with the air-fuel ratios. In areas where the air-fuel ratio is apart from the stoichiometric air-fuel ratio to a certain extent (the air-fuel ratio area on the side richer than λrich in FIG. 14 and the air-fuel ratio area on the side leaner than λlean), even when the air-fuel ratio changes to the rich/lean side, the amount of deviation from the proper value of the air-fuel ratio detection timing hardly changes. In consideration of the Z-shaped change characteristics of deviations of the air-fuel ratio detection timing according to the air-fuel ratios, therefore, one correction amount for the air-fuel ratio detection timing may be set in each of the air-fuel ratio area on the side richer than λrich in FIG. 14 and the air-fuel ratio area on the side leaner than λlean.

In a predetermined air-fuel ratio range in which the deviation (correction amount) from the proper value of the air-fuel ratio detection timing changes according to the air-fuel ratio (the range from λrich to λlean in FIG. 14), correction amounts for the air-fuel ratio detection timing may be finely set as table data at respective air-fuel ratios. It is also possible to set the air-fuel ratio detection timing correction amount by interpolation correction between table data of the correction amount in the air-fuel ratio area on the side richer than λrich and table data of the correction amount in the air-fuel ratio area on the side leaner than λlean. The interpolation correction may be linear interpolation of performing approximation with a straight line in which the air-fuel ratio detection timing correction amount becomes zero at the stoichiometric air-fuel ratio (λ=1.0) or curve interpolation (spline interpolation) of performing approximation with a ∫ shaped curve.

Setting of the air-fuel ratio detection timing and the cylinder-by-cylinder air-fuel ratio control of the third embodiment are executed by the ECU 140 in accordance with routines shown in FIGS. 15 to 18. The processes in the routines will be described below.

(Cylinder-by-Cylinder Air-Fuel Ratio Control Main Routine)

Figure 15:
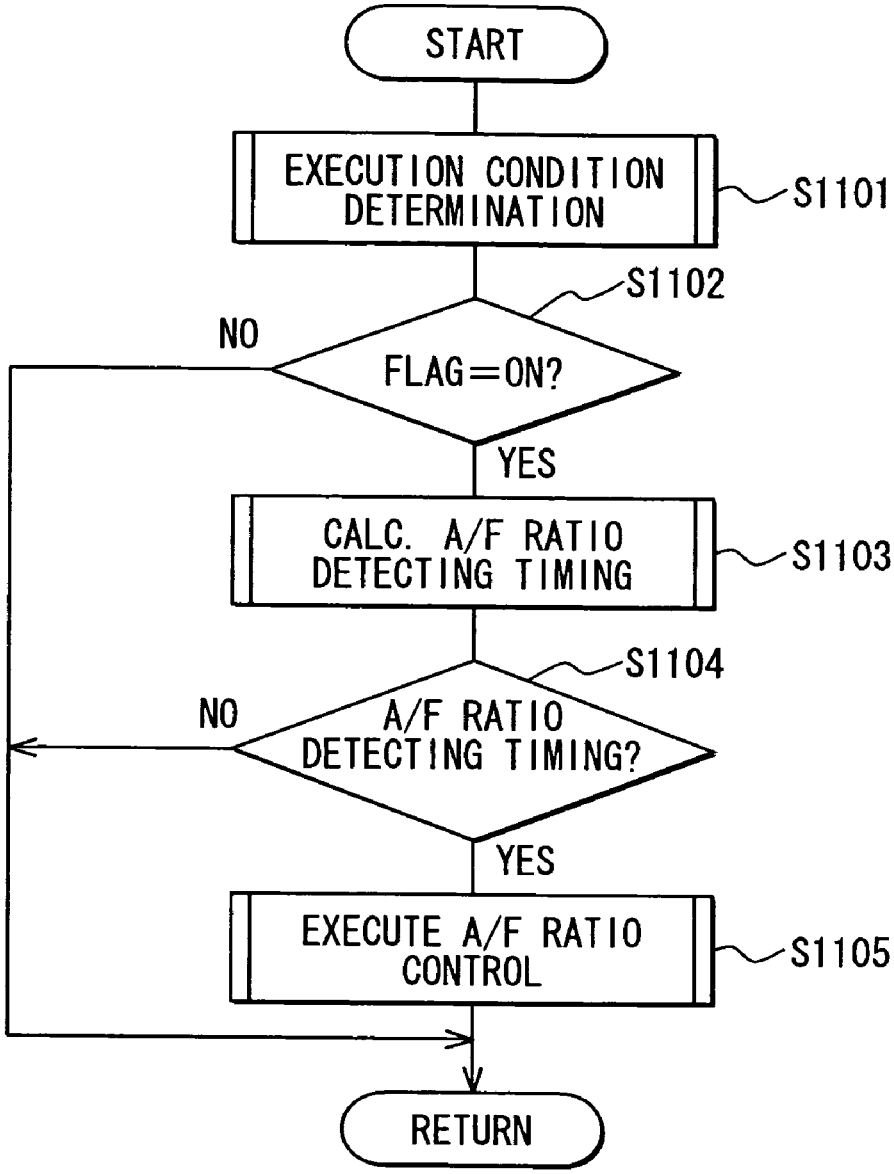
FIG. 15 is a flowchart showing the flow of processes of a cylinder-by-cylinder air-fuel ratio control main routine of the third embodiment.
Figure 16:
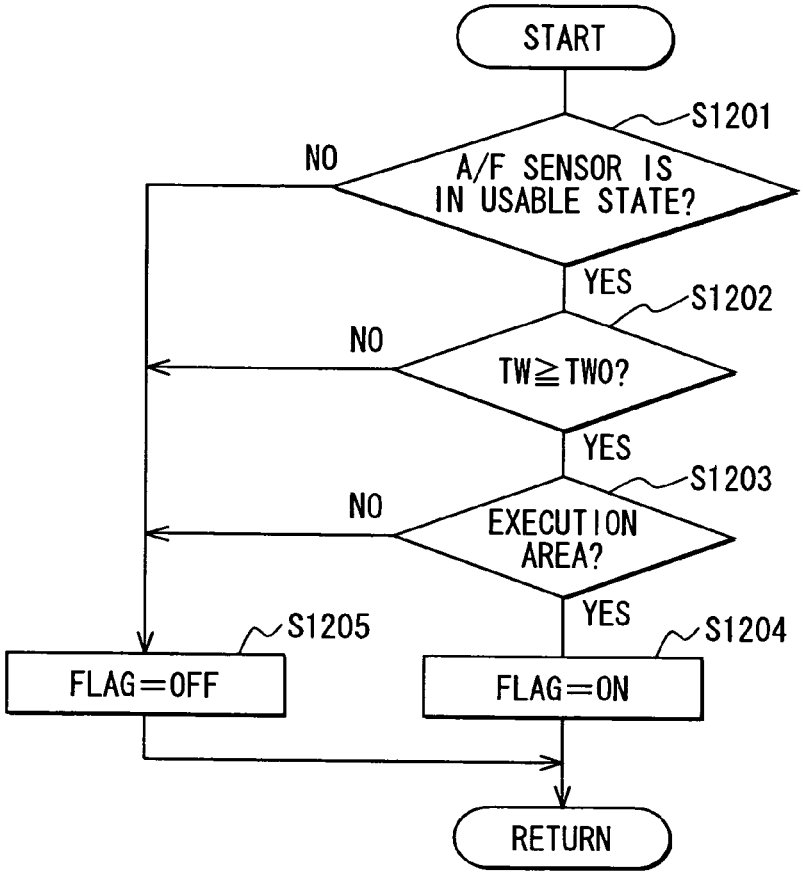
FIG. 16 is a flowchart showing the flow of processes of a cylinder-by-cylinder air-fuel ratio control execution condition determining routine of the third embodiment.

A cylinder-by-cylinder air-fuel ratio control main routine of FIG. 15 is started every predetermined crank angle (for example, 30° CA) synchronously with the output pulse of the crank angle sensor 133. When the routine is started, first, at step S1101, a cylinder-by-cylinder air-fuel ratio control execution condition determining routine of FIG. 16 which will be described later is executed to determine whether a cylinder-by-cylinder air-fuel ratio control execution condition is satisfied or not. After that, at step S1102, whether the cylinder-by-cylinder air-fuel ratio control execution condition is satisfied or not is determined depending on whether a cylinder-by-cylinder air-fuel ratio control execution flag which is set by a cylinder-by-cylinder air-fuel ratio control execution condition determining routine of FIG. 16 is ON or not. In the case where the cylinder-by-cylinder air-fuel ratio control execution flag is OFF (the executing condition is not satisfied), the routine is finished without performing the following processes.

On the other hand, in the case where the cylinder-by-cylinder air-fuel ratio control execution flag is ON (the executing condition is satisfied), the program advances to step S1103 where an air-fuel ratio detection timing computing routine of FIG. 17 which will be described later is executed to set the engine operating state such as present engine load and engine speed and the air-fuel ratio detection timing according to the target air-fuel ratio (the timing of sampling the output of the air-fuel ratio sensor 16). After that, the program advances to step S1104 and whether the present crank angle is at the air-fuel ratio detection timing of each cylinder or not is determined. If it is not the air-fuel ratio detection timing, the routine is finished without performing the following processes.

When the present crank angle is the air-fuel ratio detection timing, the program advances to step S1105 where a cylinder-by-cylinder air-fuel ratio control executing routine of FIG. 18 which will be described later is executed and a cylinder-by-cylinder air-fuel ratio control is performed.

(Cylinder-by-cylinder Air-fuel Ratio Control Execution Condition Determining Routine)

The cylinder-by-cylinder air-fuel ratio control execution condition determining routine of FIG. 16 is a subroutine executed at step S1101 of the cylinder-by-cylinder air-fuel ratio control main routine of FIG. 15. When the routine is started, first, at step S1201, whether the air-fuel ratio sensor 137 is in a usable state or not is determined. The usable state is, for example, a state in which the air-fuel ratio sensor 137 is in an active state and is not failed. If the air-fuel ratio sensor 137 is not in the usable state, the cylinder-by-cylinder air-fuel ratio control execution condition is not satisfied, and the program advances to step S1205 where the cylinder-by-cylinder air-fuel ratio control execution flag is cleared (OFF). After that, the routine is finished.

On the other hand, when the air-fuel ratio sensor 137 is in the usable state, the program advances to step S1202. At step S1202, whether or not cooling water temperature TW is a predetermined temperature TW0 or higher (the engine 111 is in a warm-up state) is determined. When the cooling water temperature is lower than the predetermined temperature, the cylinder-by-cylinder air-fuel ratio control execution condition is not satisfied. The program advances to step S1205 where the cylinder-by-cylinder air-fuel ratio control execution flag is cleared (OFF), and the routine is finished.

When the cooling water temperature is equal to or higher than the predetermined temperature, the program advances to step S1203 where whether the present engine operating area is a cylinder-by-cylinder air-fuel ratio control execution area or not is determined with reference to an operation area map using the engine speed and the engine load (for example, intake manifold pressure) as parameters. For example, in a high speed area and a low load area, accuracy of estimating the cylinder-by-cylinder air-fuel ratio deteriorates, so that the cylinder-by-cylinder air-fuel ratio control is inhibited.

If the present engine operating area is not the cylinder-by-cylinder air-fuel ratio control execution area, the cylinder-by-cylinder air-fuel ratio control execution condition is not satisfied. The program advances to step S1205 where the cylinder-by-cylinder air-fuel ratio control execution flag is cleared (OFF). After that, the routine is finished. On the other hand, when the present engine operation area is in the cylinder-by-cylinder air-fuel ratio control execution area, the cylinder-by-cylinder air-fuel ratio control execution condition is satisfied. The program advances to step S1204 where the cylinder-by-cylinder air-fuel ratio control execution flag is set (ON). After that, the routine is finished.

(Air-Fuel Ratio Detection Timing Computing Routine)

Figure 17:
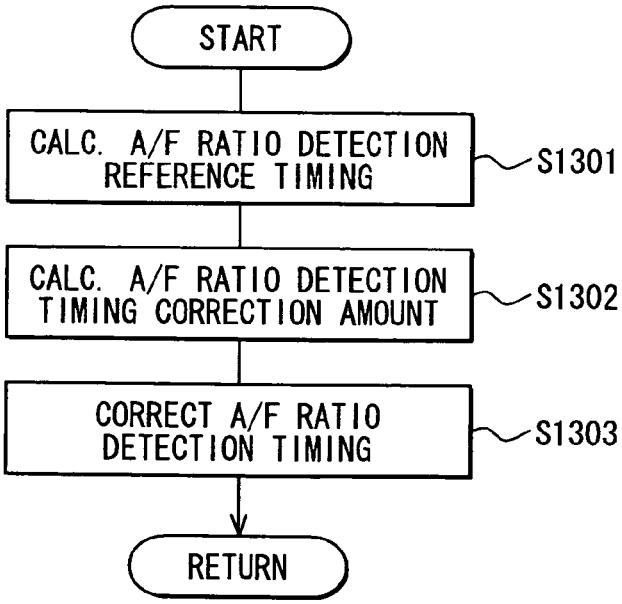
FIG. 17 is a flowchart showing the flow of processes of an air-fuel ratio detection timing computing routine of the third embodiment.

The air-fuel ratio detection timing computing routine of FIG. 17 is the subroutine executed at step S1103 of the cylinder-by-cylinder air-fuel ratio control main routine of FIG. 15. When the routine is started, first, at step S1301, an air-fuel ratio detection reference timing of each cylinder is computed by referring to a map or the like in accordance with the present engine operating state (such as engine load and engine speed). The air-fuel ratio detection reference timing corresponds to a proper air-fuel ratio detection timing when the target air-fuel ratio is the stoichiometric air-fuel ratio (excess air ratio $\lambda=1.0$).

After that, the program advances to step S1302. With reference to the table of the air-fuel ratio detection timing correction amounts which are set in consideration of the Z-shaped change characteristics of variations in the air-fuel ratio detection timings according to the air-fuel ratios, the air-fuel ratio detection timing correction amount according to the present target air-fuel ratios (or an average value of them) is computed. The correction amount for the air-fuel ratio detection timing is a negative value (correction in the direction of advancing the air-fuel ratio detection timing) at an air-fuel ratio on the rich side, and it is a positive value (correction in the direction of retarding the air-fuel ratio detection timing) at an air-fuel ratio on the lean side.

In this case, in the table of the air-fuel ratio detection timing correction amounts, correction amounts may be finely set at the respective air-fuel ratios in all of the air-fuel ratio areas. Alternatively, in consideration of the Z-shaped change characteristics of variations in the air-fuel ratio detection timings according to the air-fuel ratios, one correction amount for the air-fuel ratio detection timing may be set in each of the air-fuel ratio area on the side richer than $\lambda$rich in FIG. 14 and the air-fuel ratio area on the side leaner than $\lambda$lean.

In a predetermined air-fuel ratio range in which the response of the air-fuel ratio sensor 137 changes according to the air-fuel ratio (the range from $\lambda$rich to $\lambda$lean in FIG. 14), correction amounts for the air-fuel ratio detection timings may be finely set as table data at respective air-fuel ratios. It is also possible to set the air-fuel ratio detection timing correction amount by interpolation correction between table data of the correction amount in the air-fuel ratio area on the side richer than $\lambda$rich and table data of the correction amount in the air-fuel ratio area on the side leaner than $\lambda$lean. The interpolation correction may be performed by executing approximation with a straight line or curve line having a $\int$ shaped curve in which the air-fuel ratio detection timing correction amount is zero at the stoichiometric air-fuel ratio ($\lambda=1.0$).

A table of data of the air-fuel ratio detection timing correction amounts may be created by using, instead of the present target air-fuel ratios (or an average value of them), the present detected air-fuel ratios (or an average value of them) as a parameter.

After that, the program advances to step S1303 where the correction amount which is set according to the present target air-fuel ratios (or an average value of them) is added to the air-fuel ratio detection reference timing which is set according to the present engine operating state, thereby obtaining a final air-fuel ratio detection timing.

(air-fuel ratio detection timing)=(air-fuel ratio detection reference timing)+(correction amount)

In short, the air-fuel ratio detection reference timing (the proper air-fuel ratio detection timing at the time of the stoichiometric air-fuel ratio) which is set according to the present engine operating state is corrected with the correction amount which is set according to the present target air-fuel ratios (or an average of them), thereby determining the final air-fuel ratio detection timing. In this case, the correction amount for the air-fuel ratio detection timing is a negative value (correction in the direction of advancing the air-fuel ratio detection timing) at an air-fuel ratio on the rich side, and it is a positive value (correction in the direction of retarding the air-fuel ratio detection timing) at an air-fuel ratio on the lean side. Therefore, when the present target air-fuel ratios (or an average of them) are on the lean side, the air-fuel ratio detection timing is corrected so as to be retarded from the air-fuel ratio detection timing at the stoichiometric air-fuel ratio. When the present target air-fuel ratios are on the rich side, the air-fuel ratio detection timing is corrected so as to be advanced from the air-fuel ratio detection timing at the stoichiometric air-fuel ratio.

The processes at steps S1302 and 1303 have a function of air-fuel ratio detection timing correction.

(Cylinder-by-cylinder Air-fuel Ratio Control Executing Routine)

Figure 18:
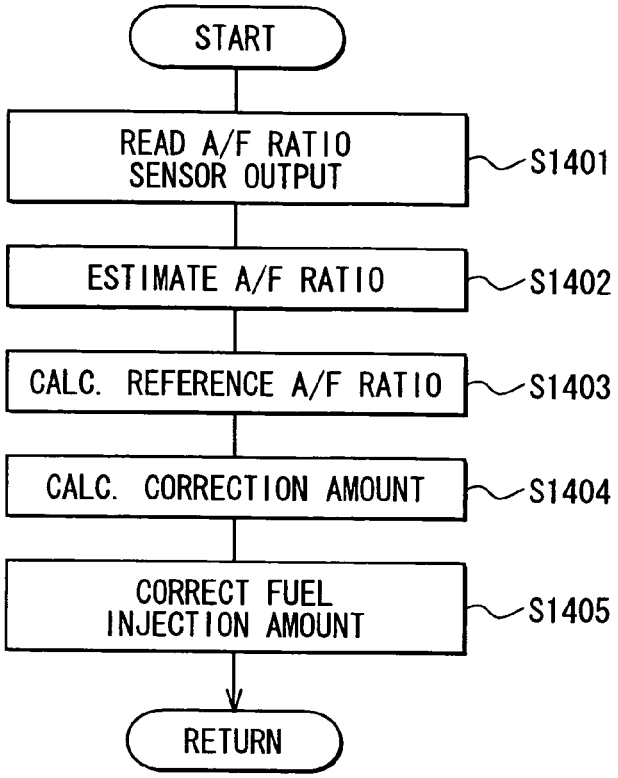
FIG. 18 is a flowchart showing the flow of processes of a cylinder-by-cylinder air-fuel ratio control executing routine of the third embodiment.

The cylinder-by-cylinder air-fuel ratio control executing routine of FIG. 18 is a subroutine executed at step S1105 of the cylinder-by-cylinder air-fuel ratio control main routine of FIG. 15.

When the routine is started, first, at step S1401, the output (air-fuel ratio detection value) of the air-fuel ratio sensor 137 is read. At step S1402, the air-fuel ratio of a cylinder of which air-fuel ratio is to be estimated is estimated on the basis of the detection value of the air-fuel ratio sensor 137 by using the cylinder-by-cylinder air-fuel ratio estimation model. The cylinder-by-cylinder air-fuel ratio is estimated in consideration of a phase shift of the air-fuel ratios of the cylinders due to irregular-interval combustions. After that, the program advances to step S1403 where an average value of the estimated air-fuel ratios of all of the cylinders is calculated and set as a base air-fuel ratio (the target air-fuel ratio of all of the cylinders).

After that, the program advances to step S1404 where the deviation between the estimated air-fuel ratio of each cylinder and the base air-fuel ratio is calculated, and the cylinder-by-cylinder correction amount is calculated so as to reduce the deviation. The program advances to step S1405 where the cylinder-by-cylinder fuel injection amount is corrected on the basis of the cylinder-by-cylinder correction amount, thereby performing a control to correct the air-fuel ratio of the air-fuel mixture to be supplied to each of the cylinders and to reduce the air-fuel ratio variations among the cylinders.

According to the foregoing third embodiment, when the target air-fuel ratios are on the lean side, the air-fuel ratio detection timing is corrected so as to be retarded from the air-fuel ratio detection timing at the stoichiometric air-fuel ratio. When the target air-fuel ratios are on the rich side, the air-fuel ratio detection timing is corrected so as to be advanced from the air-fuel ratio detection timing at the stoichiometric air-fuel ratio. Therefore, the air-fuel ratio detection timings of the cylinders can be corrected to a proper direction in accordance with the air-fuel ratio, so that the air-fuel ratio estimation accuracy of each cylinder can be improved.

Fourth Embodiment

Figure 19:
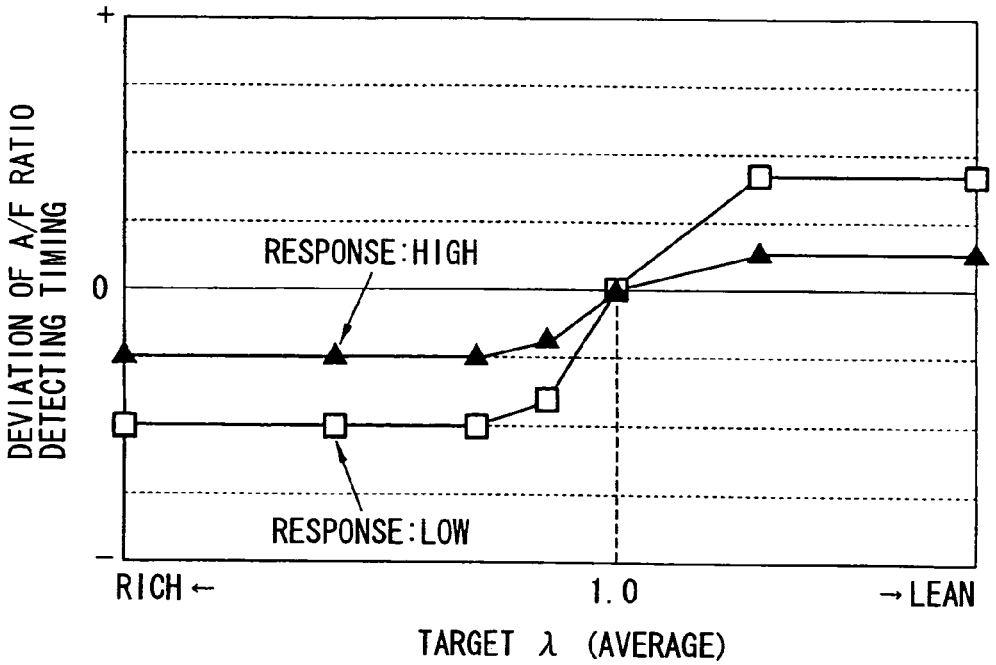
FIG. 19 is an air-fuel ratio sensor characteristic diagram showing the relations among a deviation from a proper value of an air-fuel ratio detection timing, response of an air-fuel ratio sensor, and a target air-fuel ratio (target λ).

A deviation (correction amount) from the proper value of the air-fuel ratio detection timing changes according to the response of the air-fuel ratio sensor 137, and the response of the air-fuel ratio sensor 137 changes according to a change with time and manufacture variations. As shown in FIG. 19, as the response of the air-fuel ratio sensor 137 becomes slower, the deviation (correction amount) from the proper value of the air-fuel ratio detection timing tends to increase. Therefore, in the air-fuel ratio detection timing correcting method of the first embodiment in which a change with time and manufacture variations in the response of the air-fuel ratio sensor 137 are not considered, when the change with time and manufacture variations in the response of the air-fuel ratio sensor 137 increase, deterioration in correction accuracy of the air-fuel ratio detection timing and deterioration in estimation accuracy of the air-fuel ratio of each cylinder cannot be avoided.

Figure 20:
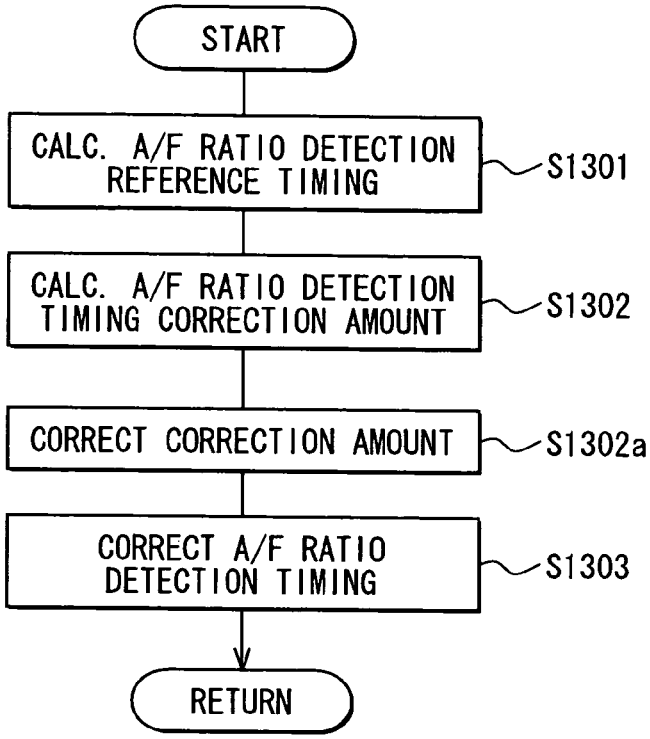
FIG. 20 is a flowchart showing the flow of processes of an air-fuel ratio detection timing computing routine of a fourth embodiment.

As a countermeasure against the deterioration, in a fourth embodiment of the invention, by executing an air-fuel ratio detection timing computing routine of FIG. 20, the air-fuel ratio detection timing correction amount which is set according to the target air-fuel ratio (or the detected air-fuel ratio) is corrected according to the response of the air-fuel ratio sensor 137 (step S1302*a*).

In this case, it is also possible to estimate a change with time in the response of the air-fuel ratio sensor 137 from, for example, integrated travel distance, the number of travel times, and the like and correct the correction amount for the air-fuel ratio detection timing which is set according to the target air-fuel ratio (or the detected air-fuel ratio) in accordance with a change with time in the response of the air-fuel ratio sensor 137.

Alternatively, in consideration of the relation such that as a deviation of the air-fuel ratio detection timing caused by a change with time or manufacture variations in the response of the air-fuel ratio sensor 137 increases, the degree of variations in the estimated air-fuel ratios among the cylinders during the cylinder-by-cylinder air-fuel ratio control increases, the degree of variations in the estimated air-fuel ratios among the cylinders may be detected as information of deviations of the air-fuel ratio detection timings. The correction amount for the air-fuel ratio detection timing which is set according to the target air-fuel ratio (or the detected air-fuel ratio) may be corrected according to the degree of variations in the estimated air-fuel ratios among the cylinders.

In such a manner, even when a deviation occurs in the air-fuel ratio detection timings due to a change with time and manufacture variations in the response of the air-fuel ratio sensor 137, the air-fuel ratio detection timing correction amount which is set according to the target air-fuel ratio (or the detected air-fuel ratio) can be properly corrected according to the change with time and manufacture variations in the response of the air-fuel ratio sensor 137. Deterioration in the accuracy of correcting the air-fuel ratio detection timing caused by a change with time and manufacture variations in the response of the air-fuel ratio sensor 137 can be prevented.

Fifth Embodiment

In the foregoing third and fourth embodiments, the air-fuel ratio detection timing correction amount is set according to the target air-fuel ratio (or the detected air-fuel ratio) with reference to the table of the preset air-fuel ratio detection timing correction amounts. In a fifth embodiment of the invention, by executing routines of FIGS. 21 to 25, a deviation (correction amount) from the proper value of the air-fuel ratio detection timing is adapted during engine operation, and the adaptation value is updated and stored in a rewritable nonvolatile memory such as a backup RAM in the ECU 140.

In this case, deviations (correction amounts) from the proper values of the air-fuel ratio detection timings in all of the air-fuel ratio areas may be finely adapted at respective air-fuel ratios. However, the relation between the air-fuel ratio and the deviation (correction amount) from the proper value of the air-fuel ratio detection timing has a characteristic that the deviation (correction amount) from the proper value of the air-fuel ratio detection timing changes in the Z shape as shown in FIG. 14. Consequently, in areas where the air-fuel ratio is apart from the stoichiometric air-fuel ratio to a certain extent (the air-fuel ratio area on the side richer than λrich in FIG. 14 and the air-fuel ratio area on the side leaner than λlean), even when the air-fuel ratio changes to the richer/leaner side, the amount of deviation from the proper value of the air-fuel ratio detection timing hardly changes. In consideration of the Z-shaped change characteristic of the deviation of the air-fuel ratio detection timing according to the air-fuel ratio, one correction amount for the air-fuel ratio detection timing may be adapted in each of the air-fuel ratio area on the side richer than λrich in FIG. 14 and the air-fuel ratio area on the side leaner than λlean. In this way, as compared with the case where the correction amounts are finely adapted at respective air-fuel ratios in all of the air-fuel ratio areas, the adaptation process is simplified, and there is an advantage that the computation load on the adaptation process can be lessened.

In this case, in a predetermined air-fuel ratio range in which the deviation (correction amount) from the proper value of the air-fuel ratio detection timing changes according to the air-fuel ratio (the range from λrich to λlean in FIG. 14), correction amounts for the air-fuel ratio detection timing may be finely adapted at respective air-fuel ratios. It is also possible to set the air-fuel ratio detection timing correction amount by interpolation correction between an adaptation value in the air-fuel ratio area on the rich side and an adaptation value in the air-fuel ratio area on the lean side. In this manner, in the predetermined air-fuel ratio range including the stoichiometric air-fuel ratio, the correction amount can be set by interpolation correction between the two adaptation values which are adapted in the air-fuel ratio areas on both sides of the range. Consequently, as compared with the case of finely adapting the correction amounts at the respective air-fuel ratios in all of the air-fuel ratio areas, the adaptation process is simplified and there is an advantage that the computation load on the adaptation process can be lessened. The interpolation correction may be linear interpolation of performing approximation with a straight line in which the correction amount becomes zero at the stoichiometric air-fuel ratio or curve interpolation (spline interpolation) of performing approximation with a ∫ shaped curve.

During adaptation of a deviation (correction amount) of the air-fuel ratio detection timing, it is preferable to inhibit controls which change the air-fuel ratio (for example, sub-feedback control, catalyst neutralizing control, and the like). By the inhibition, a deviation (correction amount) of the air-fuel ratio detection timing can be adapted with high accuracy in a state where the air-fuel ratio is maintained to be constant.

As shown in FIG. 14, in areas where the air-fuel ratio is apart from the stoichiometric air-fuel ratio to a certain extent, even when the air-fuel ratio changes to the rich/lean side, the deviation of the air-fuel ratio detection timing hardly changes. Consequently, in the case of adapting the deviation of the air-fuel ratio detection timing in the air-fuel ratio areas, a change in the air-fuel ratio in the air-fuel ratio areas may be permitted and only a change in the air-fuel ratio outside the air-fuel ratio area may be inhibited.

It is preferable to execute adaptation in predetermined cycles in order to update an adaptation value in accordance with a change with time of the response of the air-fuel ratio sensor 137. For example, adaptation operation is performed during the first travel after the adaptation value is cleared by replacement of an in-vehicle battery. After that, the adaptation operation is executed after lapse of a predetermined period, every predetermined integral travel distance, every predetermined number of travel times, or every predetermined number of fueling times. In such a manner, the adaptation value can be updated according to a change with time of the response of the air-fuel ratio sensor 137.

When an adaptation execution condition is satisfied during operation of the engine 111 at a lean/rich air-fuel ratio, a deviation of the air-fuel ratio detection timing may be adapted. A deviation of the air-fuel ratio detection timing may be adapted by forcedly changing the target air-fuel ratio to the lean or rich side at the time of adaptation. In this case, in a state where an oxygen storage amount (oxygen occlusion amount) of the catalyst 138 for cleaning exhaust gas increases to a saturation level, the capability of reducing lean components such as NOx of the catalyst 138 decreases. When the air-fuel ratio is forcedly changed to the lean side in this state, an exhaust amount of the lean components such as NOx which cannot be reduced by the catalyst 138 increases. In a state where the oxygen storage amount of the catalyst 138 is small, the capability of reducing rich components such as HC and CO of the catalyst 138 decreases. If the target air-fuel ratio is forcedly changed to the rich state and the adaptation operation is performed in this state, an exhaust amount of the rich components such as HC and CO which cannot be reduced by the catalyst 138 increases.

As a countermeasure, the period in which the target air-fuel ratio is changed to the lean or rich side and the adaptation operation is executed may be determined on the basis of the state of the catalyst 138. In this way, for example, by forcedly changing the target air-fuel ratio to the rich side when the capability of reducing rich components of HC, CO, and the like of the catalyst 138 is high (when the oxygen storage amount is large), a deviation of the air-fuel ratio detection timing can be adapted without deteriorating the emission in the rich-side air-fuel ratio area. By forcedly changing the target air-fuel ratio to the lean side when the capability of reducing lean components such as NOx of the catalyst 138 is high (when the oxygen storage amount is small), a deviation of the air-fuel ratio detection timing can be adapted without deteriorating the emission in the lean-side air-fuel ratio area. Thus, the problem of deterioration in the emission at the time of adaptation can be solved.

The air-fuel ratio detection timing adaptation correction and the cylinder-by-cylinder air-fuel ratio control of the third embodiment are executed by the ECU 140 in accordance with routines of FIGS. 21 to 25. The processes of the routines will be described below.

(Cylinder-by-cylinder Air-fuel Ratio Control Main Routine)

Figure 21:
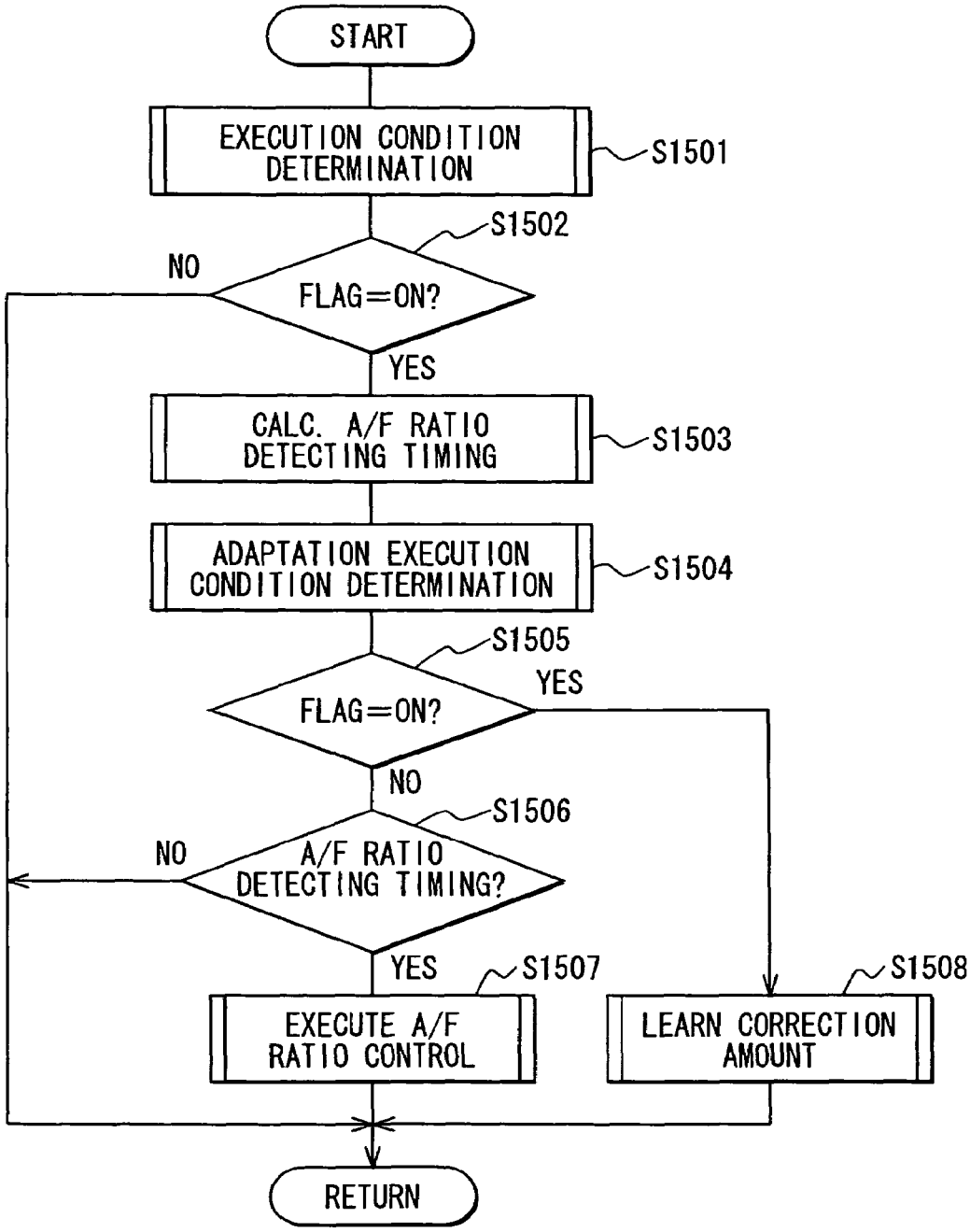
FIG. 21 is a flowchart showing the flow of processes of a cylinder-by-cylinder air-fuel ratio control main routine of a fifth embodiment.

A cylinder-by-cylinder air-fuel ratio control main routine of FIG. 21 is started every predetermined crank angle (for example, 30° CA) synchronously with an output pulse of the crank angle sensor 133. When the routine is started, first, at step S1501, the cylinder-by-cylinder air-fuel ratio control execution condition determining routine of FIG. 16 described in the foregoing first embodiment is executed, and whether the condition of executing the cylinder-by-cylinder air-fuel ratio control is satisfied or not is determined. After that, at step S1502 , whether the condition of executing the cylinder-by-cylinder air-fuel ratio control is satisfied or not is determined by determining whether the cylinder-by-cylinder air-fuel ratio control execution flag which is set in the cylinder-by-cylinder air-fuel ratio control execution condition determining routine of FIG. 16 is ON or not. In the case where it is determined that the cylinder-by-cylinder air-fuel ratio control execution flag is OFF (the execution condition is not satisfied), the routine is finished without performing the following processes.

On the other hand, when it is determined that the cylinder-by-cylinder air-fuel ratio control execution flag is ON (the execution condition is satisfied), the program advances to step S1503. An air-fuel ratio detection timing computing routine of FIG. 22 which will be described later is executed to set an air-fuel ratio detecting timing according to the engine operating state such as present engine load and engine speed and the target air-fuel ratio. After that, the program advances to step S1504 where a correction amount adaptation execution condition determining routine of FIG. 23 which will be described later is executed to determine whether an execution condition of adaptation the correction amount for the air-fuel ratio detection timing according to the target air-fuel ratio is satisfied or not.

Figure 23:
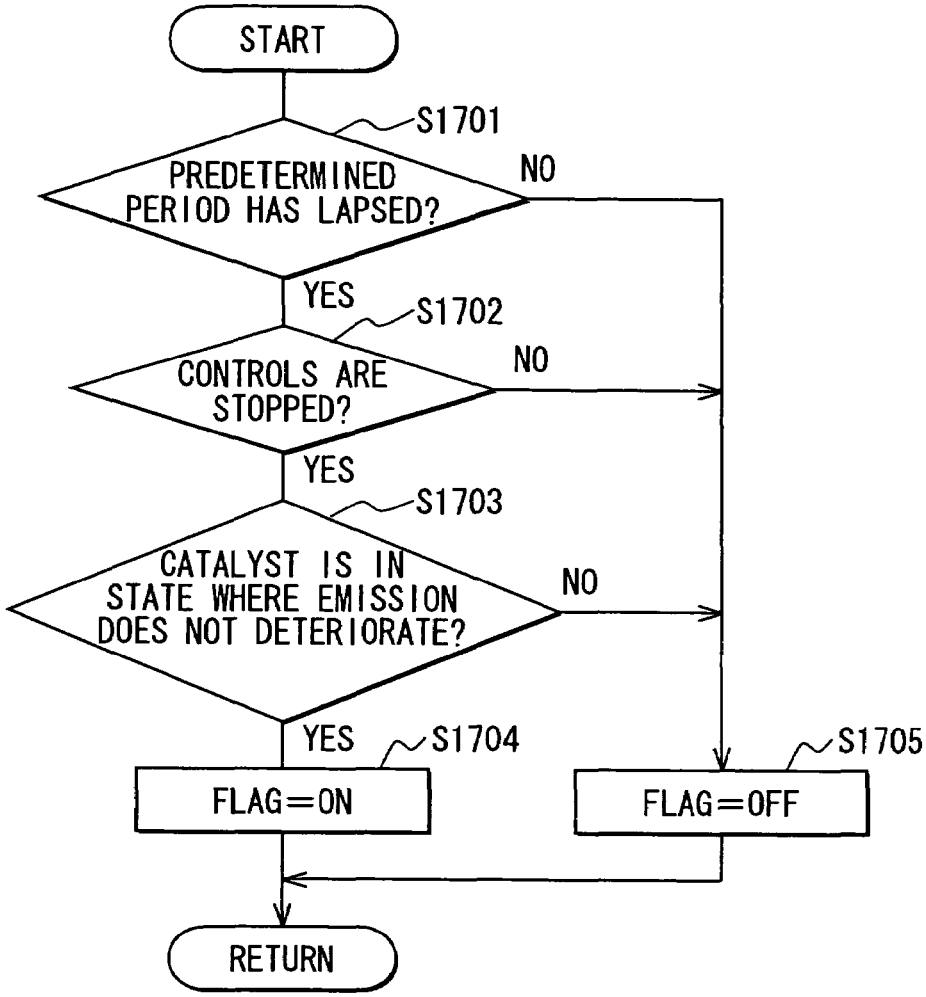
FIG. 23 is a flowchart showing the flow of processes of a correction amount adaptation execution condition determining routine of the fifth embodiment.

After that, the program advances to step S1505 and whether the execution condition of adapting the correction amount is satisfied or not is determined by detecting whether the correction amount adaptation execution flag which is set in the correction amount adaptation execution condition determining routine of FIG. 23 is ON or not. In the case where it is determined that the correction amount adaptation execution flag is OFF (the execution condition is not satisfied), the program advances to step S1506. Whether the present crank angle corresponds to the air-fuel ratio detection timing of each cylinder or not is determined. If NO, the routing is finished without performing the following processes.

On the other hand, when the present crank angle corresponds to the air-fuel ratio detection timing, the program advances to step S1507. The cylinder-by-cylinder air-fuel ratio control execution routine of FIG. 18 described in the foregoing third embodiment is executed to perform the cylinder-by-cylinder air-fuel ratio control.

In the case where it is determined at step S1505 that the correction amount adaptation execution flag is ON (the execution condition is satisfied), the program proceeds to step S1508. A correction amount adaptation routine of FIGS. 24 and 25 which will be describe later is executed to adapt the air-fuel ratio detection timing correction amount according to the target air-fuel ratio.

(Air-fuel Ratio Detection Timing Computing Routine)

Figure 22:
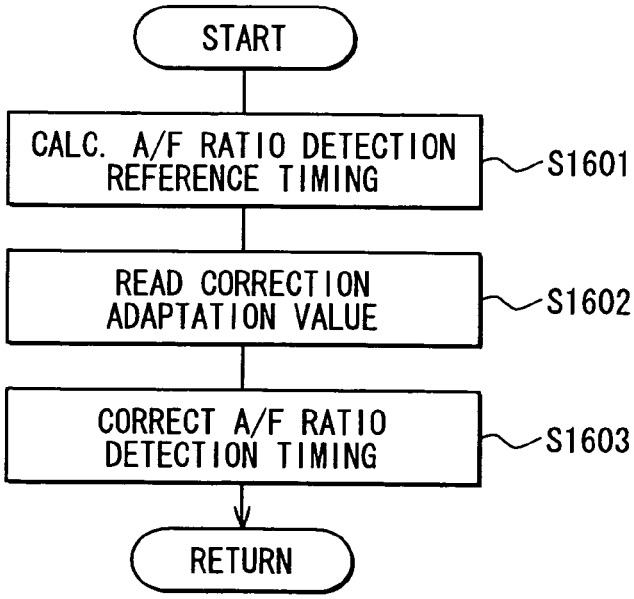
FIG. 22 is a flowchart showing the flow of processes of an air-fuel ratio detection timing computing routine of the fifth embodiment.

The air-fuel ratio detection timing computing routine of FIG. 22 is a subroutine executed at step S1503 in the cylinder-by-cylinder air-fuel ratio control main routine of FIG. 21. When the routine is started, first, at step S1601, an air-fuel ratio detection reference timing of each cylinder is computed by referring to a map or the like in accordance with the present engine operating state (such as engine load and engine speed). The air-fuel ratio detection reference timing corresponds to a proper air-fuel ratio detection timing when the target air-fuel ratio is the stoichiometric air-fuel ratio (excess air ratio $\lambda=1.0$).

After that, the program advances to step S1302. With reference to the table of the air-fuel ratio detection timing correction amount adaptation values obtained by the correction amount adaptation routine of FIGS. 24 and 25 to be described later, an adaptation value of the correction amount of the air-fuel ratio detection timing according to the present target air-fuel ratio (or the detected air-fuel ratio) is read (or corrected by interpolation). The adaptation value of the correction amount for the air-fuel ratio detection timing is a negative value (correction in the direction of advancing the air-fuel ratio detection timing) at an air-fuel ratio on the rich side, and it is a positive value (correction in the direction of retarding the air-fuel ratio detection timing) at an air-fuel ratio on the lean side.

After that, the program advances to step S1603 where the correction amount adaptation value according to the present target air-fuel ratios (or the detected air-fuel ratio) is added to the air-fuel ratio detection reference timing which is set according to the present engine operating state, thereby obtaining a final air-fuel ratio detection timing.

(air-fuel ratio detection timing)=(air-fuel ratio detection reference timing)+(correction amount adaptation value)

In short, the air-fuel ratio detection reference timing (the proper air-fuel ratio detection timing at the time of the stoichiometric air-fuel ratio) which is set according to the present engine operating state is corrected with the correction amount adaptation value according to the present target air-fuel ratios (or the detected air-fuel ratio), thereby determining the final air-fuel ratio detection timing.

(Correction Amount Adaptation Execution Condition Determining Routine)

The correction amount adaptation execution condition determining routine of FIG. 23 is a subroutine executed at step S1504 in the cylinder-by-cylinder air-fuel ratio control main routine of FIG. 21. When the routine is started, first, at step S1701, it is determined whether it is the first travel after the correction amount adaptation value is cleared due to replacement of an in-vehicle battery or not, or whether a predetermined period (predetermined integral travel distance, predetermined number of travel times, or the like) has lapsed since the adaptation operation of last time. If the determination result is "No", the correction amount adaptation execution condition is not satisfied. The program advances to step S1705 where the correction amount adaptation execution flag is cleared (OFF), and finishes the routine.

On the other hand, when it is determined as "Yes" in the step S1701, the program advances to step S1702. Whether controls which change the air-fuel ratio (for example, sub-feedback control, catalyst neutralizing control, and the like) are stopped (inhibited) or not except for the cylinder-by-cylinder air-fuel ratio control is determined. If the controls which change the air-fuel ratio are not stopped, the correction amount adaptation execution condition is not satisfied. The program advances to step S1705 where the correction amount adaptation execution flag is cleared (OFF), and finishes the routine.

If the controls which change the air-fuel ratio are stopped at step S1702, the program advances to step S1703 where it is determined whether or not the catalyst 138 is in the state where emission does not deteriorate even when the adaptation of the correction amount is executed (that is, even when the target air-fuel ratio is changed to adapt the correction amount). When the catalyst 138 is in the state where emission deteriorates if the adaptation of the correction amount is executed, the correction amount adaptation execution condition is not satisfied. The program advances to step S1705 where the correction amount adaptation execution flag is cleared (OFF), and the routine is finished. On the other hand, when the catalyst 138 is in the state where emission does not deteriorate even if the adaptation of the correction amount is executed, the correction amount adaptation execution condition is satisfied. The program advances to step S1704 where the correction amount adaptation execution flag is set (ON), and the routine is finished.

(Correction Amount Adaptation Routine)

Figure 26:
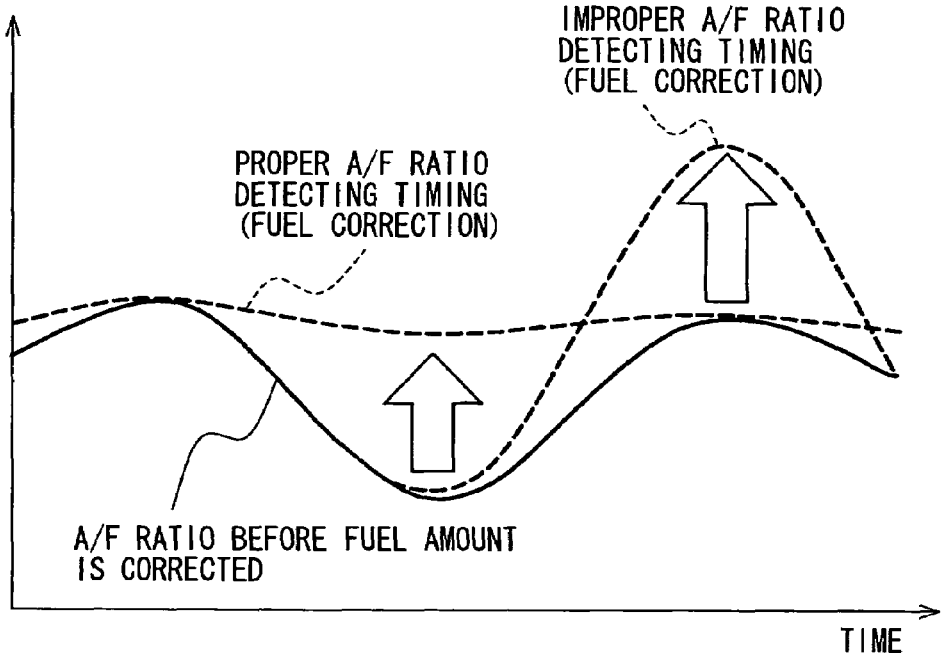
FIG. 26 is a time chart illustrating a method of detecting a deviation from a proper value of an air-fuel ratio detection timing of the fifth embodiment.
Figure 27:
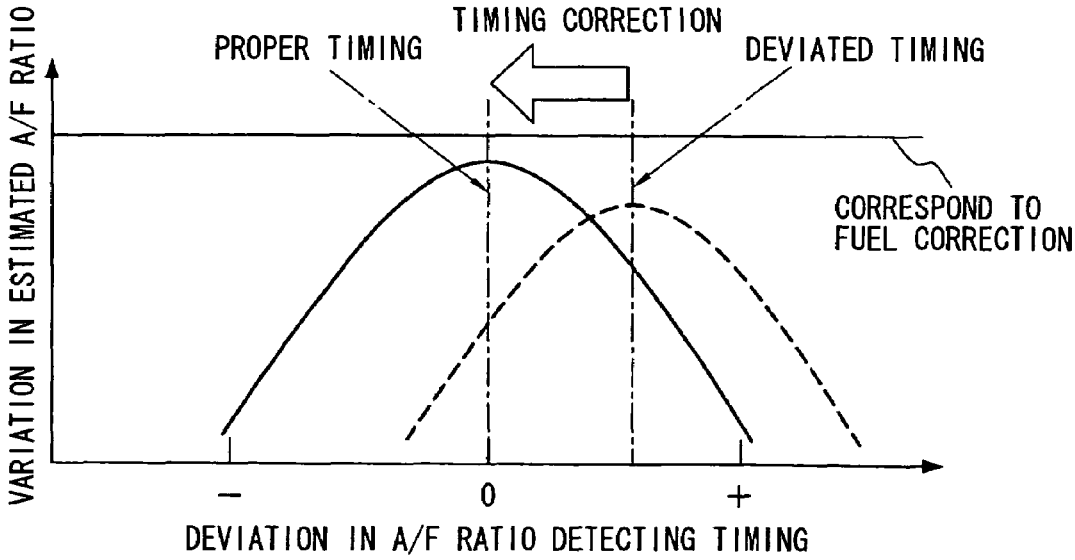
FIG. 27 is a time chart illustrating a method of adaptation a correction amount for the air-fuel ratio detection timing of the fifth embodiment.

First, a method of adaptation the correction amount for the air-fuel ratio detection timing will be described with reference to FIGS. 26 and 27. FIGS. 26 and 27 are diagrams illustrating effects of correction of the fuel injection amount (fuel correction) in the case where the air-fuel ratio detection timing is proper and in the case where the air-fuel ratio detection timing is improper. In the case where the air-fuel ratio detection timing is proper, the air-fuel ratio of each cylinder can be estimated with high accuracy. Consequently, when the fuel injection amount of a predetermined cylinder is corrected by a predetermined amount, the air-fuel ratio of the cylinder should change by the amount corresponding to the fuel correction amount. Attention is paid to the characteristic. In the third embodiment, by executing the correction amount adaptation routine of FIGS. 24 and 25, the air-fuel ratio detection timing of each cylinder is changed. The air-fuel ratios before and after the fuel correction in each cylinder at the air-fuel ratio detection timing are estimated. The air-fuel ratio detection timing by which the change amount between the estimated air-fuel ratios before and after the fuel correction corresponds to the fuel correction amount is determined as a proper air-fuel ratio detection timing, and a deviation (correction amount) from the proper value of the air-fuel ratio detection timing is adapted.

Figure 24:
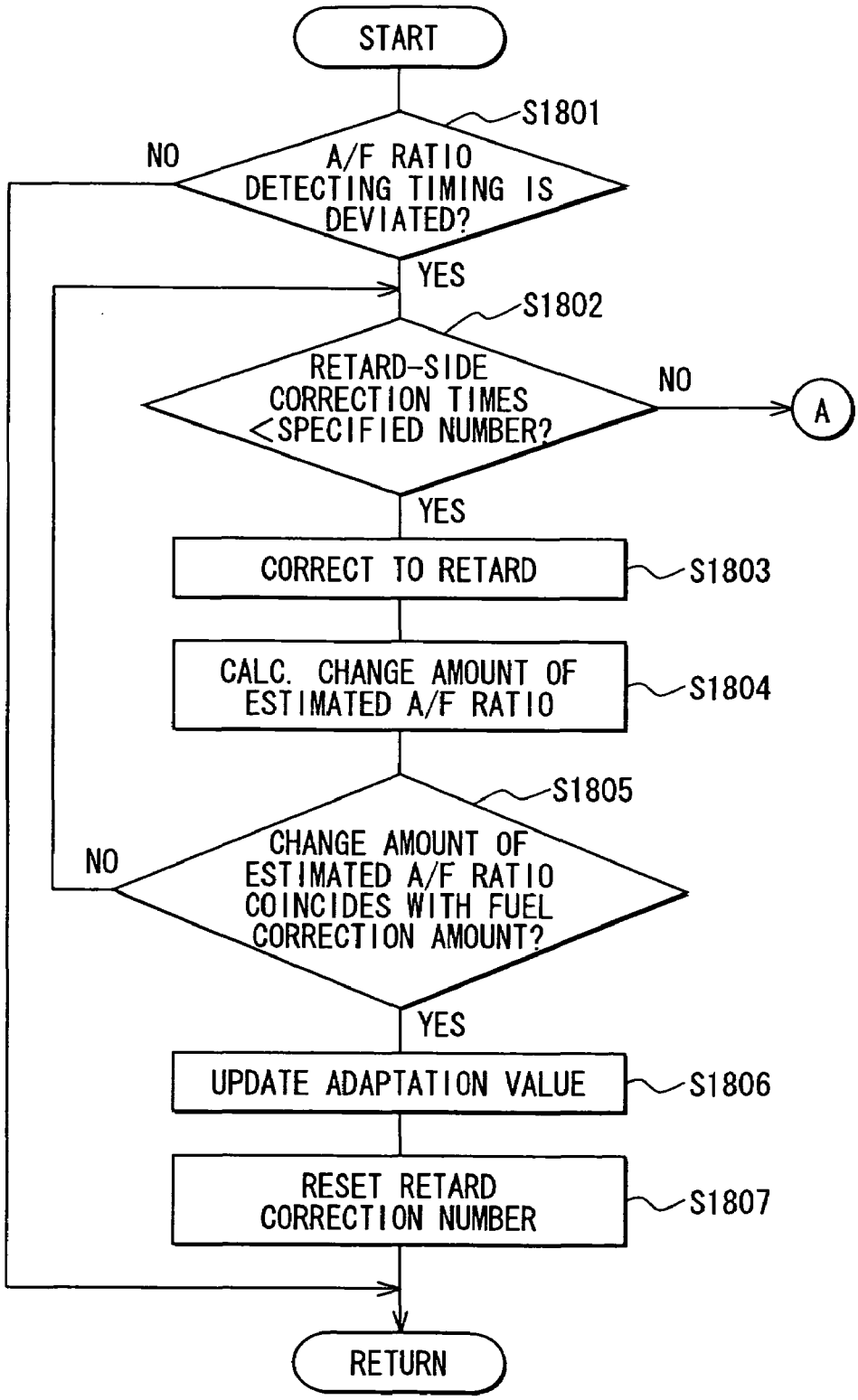
FIG. 24 is a flowchart showing the flow of processes of a correction amount adaptation routine of the fifth embodiment.
Figure 25:
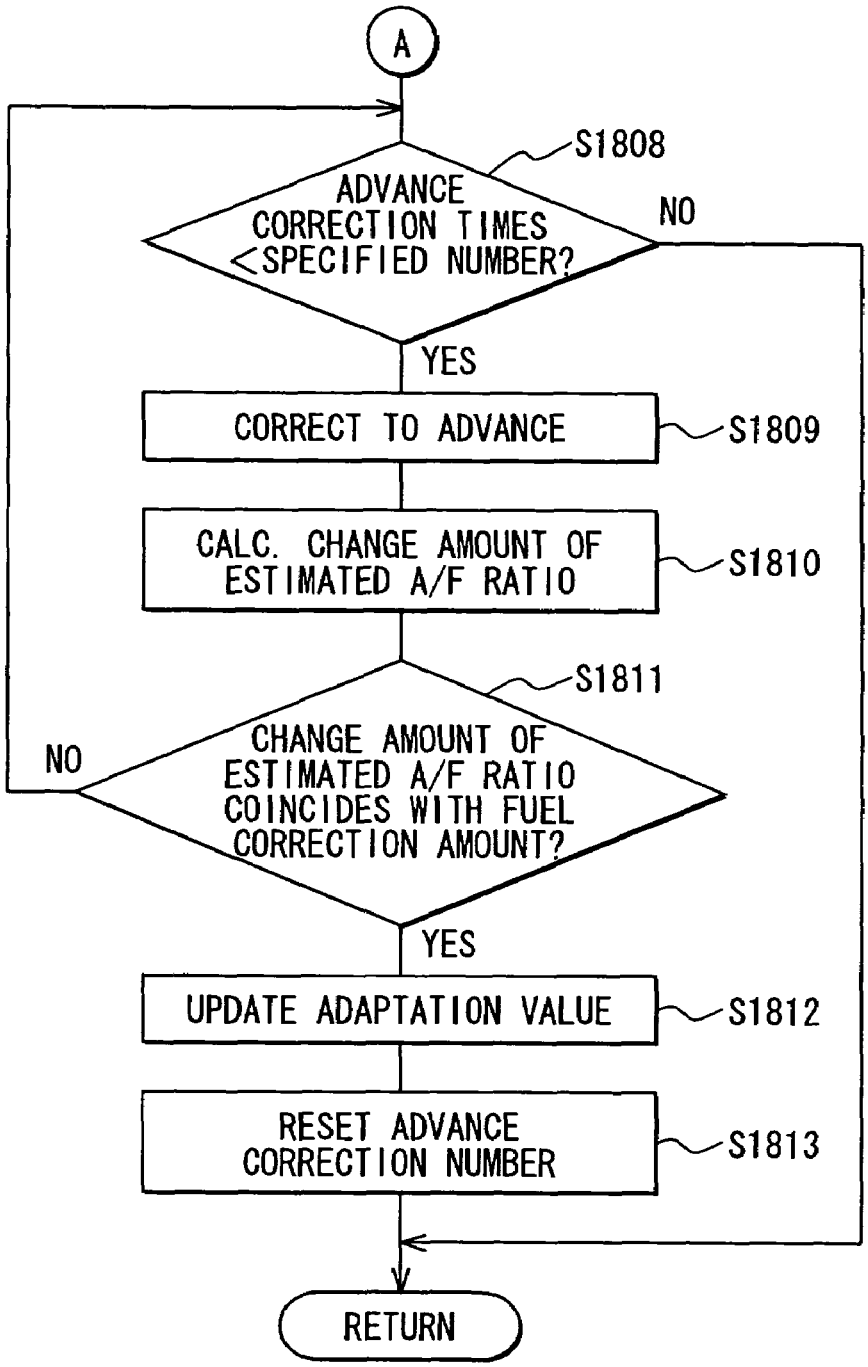
FIG. 25 is a (second) flowchart showing the flow of processes of the correction amount adaptation routine of the fifth embodiment.

The correction amount adaptation routine of FIGS. 24 and 25 is a sub routine executed at step S1508 in the cylinder-by-cylinder air-fuel ratio control main routine of FIG. 21. When the routine is started, first, at step S1801, whether the air-fuel ratio detection timing is deviated or not is determined on the basis of the degree of variations in the estimated air-fuel ratios among the cylinders which are under the cylinder-by-cylinder air-fuel ratio control. The determination is made, for example, on the basis of the following condition (A1) and/or the condition (A2).

(A1) Whether the degree of variations in the estimated air-fuel ratios among the cylinders is large or not is determined by detecting if the deviation between the maximum estimated air-fuel ratio and the minimum estimated air-fuel ratio among the estimated air-fuel ratios of each cylinder is equal to or larger than a predetermined value.

(A2) Whether the degree of variations in the estimated air-fuel ratios among the cylinders is large or not is determined by detecting if a standard deviation of the estimated air-fuel ratios of all of cylinders is equal to or larger than the predetermined value.

If the degree of variations in the estimated air-fuel ratios among cylinders is large, it is determined that the air-fuel ratio detection timing is off. If the degree of variations in the estimated air-fuel ratios among cylinders is small, it is determined that the air-fuel ratio detection timing is not off.

When it is determined that the air-fuel ratio detection timing is not off, there is no need to adapt the correction amount. Consequently, the routine is finished without performing the following adaptation process.

On the other hand, when it is determined that the air-fuel ratio detection timing is off, the program advances to step S1802 . Whether the number of retard-side correction times (the number of times of correcting the air-fuel ratio detection timing to the retard side) is less than a specified number or not is determined. If the number of retard-side correction times is less than the specified number, the program advances to step S1803 where the air-fuel ratio detection timing is corrected to the retard side only by a predetermined crank angle. After that, the program advances to step S1804 where the air-fuel ratios before and after the fuel correction of the cylinder at the air-fuel ratio detection timing subjected to the retard-side correction are estimated, and the change amount between the estimated air-fuel ratios before and after the fuel correction is calculated.

After that, the program proceeds to step S1805 where whether the present air-fuel ratio detection timing is a proper air-fuel ratio detection timing or not is determined by deciding whether the change amount of the estimated air-fuel ratios almost coincides with the amount corresponding to the fuel correction amount or not. If it is determined that the present air-fuel ratio detection timing is not a proper air-fuel ratio detection timing, the program returns to step S1802, and the retard-side correction of the air-fuel ratio detection timing is repeated.

When the change amount of the estimated air-fuel ratios almost coincides with the amount corresponding to the fuel correction amount and it is determined that the air-fuel ratio detection timing becomes a proper air-fuel ratio detection timing before the number of retard-side correction times reaches the specified number, the program proceeds to step S1806. The air-fuel ratio detection timing at that time point is determined as a proper air-fuel ratio detection timing. The deviation between the proper air-fuel ratio detection timing and the air-fuel ratio detection timing before the retard-side correction is adapted as an air-fuel ratio detection timing correction amount. The adaptation value is updated and stored in an adaptation value storing area in a rewriteable nonvolatile memory such as a backup RAM in the ECU 140. Considering that the air-fuel ratio detection timing correction amount changes according to the air-fuel ratio, the correction amount adaptation value is updated and stored at each air-fuel ratio. Alternatively, in consideration of the Z-shaped change characteristics of deviations of the air-fuel ratio detection timing according to the air-fuel ratios, therefore, one correction amount for the air-fuel ratio detection timing may be adapted in each of the air-fuel ratio area on the side richer than λrich in FIG. 14 and the air-fuel ratio area on the side leaner than λlean.

After that, the program advances to step S1807 where the count value of the number of retard-side correction times is reset, and finishes the routine.

On the other hand, the air-fuel ratio detection timing did not become a proper air-fuel ratio detection timing after repetition of the retard-side correction of the air-fuel ratio detection timing the specified number of times, the program advances to step S1808 of FIG. 25. Whether the number of advance-side correction times (the number of times of correcting the air-fuel ratio detection timing to the advance side) is less than a specified number or not is determined. If the number of advance-side correction times is less than the specified number, the program advances to step S1809 where the air-fuel ratio detection timing is corrected from the initial position before the retard-side correction to the advance side only by a predetermined crank angle. After that, the program advances to step S1810 where the air-fuel ratios before and after the fuel correction of the cylinder at the air-fuel ratio detection timing subjected to the advance-side correction are estimated, and the change amount between the estimated air-fuel ratios before and after the fuel correction is calculated.

After that, the program proceeds to step S1811 where whether the present air-fuel ratio detection timing is a proper air-fuel ratio detection timing or not is determined by deciding whether the change amount of the estimated air-fuel ratios almost coincides with the amount corresponding to the fuel correction amount or not. If it is determined that the present air-fuel ratio detection timing is not a proper air-fuel ratio detection timing, the program returns to step S1808, and the advance-side correction of the air-fuel ratio detection timing is repeated.

When the change amount of the estimated air-fuel ratios almost coincides with the amount corresponding to the fuel correction amount and it is determined that the air-fuel ratio detection timing becomes a proper air-fuel ratio detection timing before the number of advance-side correction times reaches the specified number, the program proceeds to step S1812. The air-fuel ratio detection timing at that time point is determined as a proper air-fuel ratio detection timing. The deviation between the proper air-fuel ratio detection timing and the air-fuel ratio detection timing before the advance-side correction is adapted as an air-fuel ratio detection timing correction amount. The correction amount adaptation value is updated and stored in an adaptation value storing area in a rewriteable nonvolatile memory such as a backup RAM in the ECU 140. After that, the program advances to step S1813 where the count value of the number of advance-side correction times is reset, and finishes the routine.

A correction amount adaptation map created by the routine is used as a map for reading the air-fuel ratio detection timing correction amount adaptation value in step S1602 in the air-fuel ratio detection timing computing routine of FIG. 22.

In the case where the air-fuel ratio detection timing did not become a proper air-fuel ratio detection timing (that is, in the case where a proper air-fuel ratio detection timing could not be adapted) after repetition of the advance-side correction of the air-fuel ratio detection timing the specified number of times, it is determined "No" in step S1808, and the routine is finished.

In the foregoing third embodiment, a deviation from the proper value of the air-fuel ratio detection timing is adapted as an air-fuel ratio detection timing correction amount during engine operation, and the correction amount adaptation value is updated and stored in the rewritable nonvolatile memory. Therefore, a deviation (correction amount) from the proper value of the air-fuel ratio detection timing can be adapted during engine operation on the basis of not only a deviation according to the air-fuel ratio but also deviations caused by a change with time in response and manufacture variations of the air-fuel ratio sensor 137. Thus, also in a system in which the influence of a change with time in response and manufacture variations of the air-fuel ratio sensor 17 cannot be ignored, the air-fuel ratio detection timing correction amount can be properly set in consideration of not only a deviation according to the air-fuel ratio but also deviations caused by a change with time in response and manufacture variations of the air-fuel ratio sensor. The air-fuel ratio estimation accuracy of each cylinder can be improved.

The present invention is not limited to an inlet port injection engine as shown in FIG. 12 but can be also applied to a cylinder injection engine.

What is claimed is:

1. A cylinder-by-cylinder air-fuel ratio controller for an internal combustion engine comprising:

an air-fuel ratio sensor for detecting an air-fuel ratio of an exhaust gas of cylinders of the internal combustion engine, the air-fuel ratio sensor being mounted in an exhaust collection part in which the exhaust gas gathers and flows;

cylinder-by-cylinder air-fuel ratio estimating means for estimating the air-fuel ratio of each cylinder on the basis of a detection value of the air-fuel ratio sensor at each of air-fuel ratio detection timings of the cylinders; and cylinder-by-cylinder air-fuel ratio control means for performing a control to make the air-fuel ratio of each cylinder coincide with a target air-fuel ratio on the basis of the estimated air-fuel ratio of each cylinder, and correcting means for correcting the air-fuel ratio detection timing in accordance with the target air-fuel ratio or the detected air-fuel ratio, wherein the correcting means corrects the air-fuel ratio detection timing so as to be retarded with respect to the air-fuel ratio detection timing at the stoichiometric air-fuel ratio when the target air-fuel ratio or the detected air-fuel ratio is lean, and the correcting means corrects the air-fuel ratio detection timing so as to be advanced with respect to the air-fuel ratio detection timing at the stoichiometric air-fuel ratio when the target air-fuel ratio or the detected air-fuel ratio is rich.

2. A cylinder-by-cylinder air-fuel ratio controller for an internal combustion engine according to claim 1, wherein the air-fuel ratio detection timing correcting means corrects an air-fuel ratio detection timing correction amount which is set according to the target air-fuel ratio or the detected air-fuel ratio in accordance with response of the air-fuel ratio sensor.

3. A cylinder-by-cylinder air-fuel ratio controller for an internal combustion engine according to claim 1, further comprising adaptation means for adapting a deviation from a proper value of the air-fuel ratio detection timing during operation of the internal combustion engine and updating and storing the adaptation value in a rewritable nonvolatile memory, wherein the air-fuel ratio detection timing correcting means corrects the air-fuel ratio detection timing on the basis of the adaptation value of the adaptation means.

4. A cylinder-by-cylinder air-fuel ratio controller for an internal combustion engine according to claim 3, wherein the adaptation means adapts a deviation from a proper value of the air-fuel ratio detection timing at each of air-fuel ratios.

5. A cylinder-by-cylinder air-fuel ratio controller for an internal combustion engine according to claim 3, wherein the adaptation means adapts one deviation from a proper value of the air-fuel ratio detection timing in each of an air-fuel ratio area on the side richer than a predetermined air-fuel ratio range including the stoichiometric air-fuel ratio and an air-fuel ratio area on the side leaner than the predetermined air-fuel ratio range.

6. A cylinder-by-cylinder air-fuel ratio controller for an internal combustion engine according to claim 5, wherein when the target air-fuel ratio or the detected air-fuel ratio is in the predetermined air-fuel ratio range including the stoichiometric air-fuel ratio, the air-fuel ratio detection timing correcting means sets a correction amount for the air-fuel ratio detection timing by interpolation correction between an adaptation value in the rich-side air-fuel ratio area and a adaptation value in the lean-side air-fuel ratio area, which are adapted by the adaptation means.

7. A cylinder-by-cylinder air-fuel ratio controller for an internal combustion engine according to claim 3, wherein the adaptation means has means for inhibiting a control for changing the air-fuel ratio during an operation of adapting a deviation from the proper value of the air-fuel ratio detection timing.

8. A cylinder-by-cylinder air-fuel ratio controller for an internal combustion engine according to claim 3, wherein the adaptation means executes the adaptation operation at predetermined intervals to update an adaptation value according to a change with time in response of the air-fuel ratio sensor.

9. A cylinder-by-cylinder air-fuel ratio controller for an internal combustion engine according to claim 3, wherein the adaptation means determines a time in which the air-fuel ratio is changed to a lean side or a rich side and a adaptation operation is performed on the basis of a state of a catalyst for purifying exhaust gas.

10. A cylinder-by-cylinder air-fuel ratio controlling method for an internal combustion engine in which an air-fuel ratio sensor for detecting an air-fuel ratio of an exhaust gas of cylinders of the internal combustion engine is mounted in an exhaust collection part in which the exhaust gas gathers and flows, the air-fuel ratio of each cylinder is estimated on the basis of a detection value of the air-fuel ratio sensor at each of air-fuel ratio detection timings of the cylinders, and the air-fuel ratio of each cylinder is controlled so as to coincide with a target air-fuel ratio on the basis of the estimated air-fuel ratio of each cylinder, the method comprising:

correcting the air-fuel ratio detection timing in accordance with the target air-fuel ratio or the detected air-fuel ratio; and correcting the air-fuel ratio detection timing so as to be retarded with respect to the air-fuel ratio detection timing at the stoichiometric air-fuel ratio when the target air-fuel ratio or the detected air-fuel ratio is lean, and correcting the air-fuel ratio detection timing so as to be advanced with respect to the air-fuel ratio detection timing at the stoichiometric air-fuel ratio when the target air-fuel ratio or the detected air-fuel ratio is rich.

11. A cylinder-by-cylinder air-fuel ratio controlling method for an internal combustion engine according to claim 10, wherein an air-fuel ratio detection timing correction amount which is set according to the target air-fuel ratio or the detected air-fuel ratio is corrected in accordance with response of the air-fuel ratio sensor.

12. A cylinder-by-cylinder air-fuel ratio controlling method for an internal combustion engine according to claim 10, further comprising:

adapting a deviation from a proper value of the air-fuel ratio detection timing during operation of the internal combustion engine and updating and storing the adaptation value in a rewritable nonvolatile memory; and correcting the air-fuel ratio detection timing on the basis of the adaptation value of the adaptation means.

13. A cylinder-by-cylinder air-fuel ratio controlling method for an internal combustion engine according to claim 12, wherein a deviation from a proper value of the air-fuel ratio detection timing is adapted at each of air-fuel ratios.

14. A cylinder-by-cylinder air-fuel ratio controlling method for an internal combustion engine according to claim 12, wherein one deviation from a proper value of the air-fuel ratio detection timing is adapted in each of an air-fuel ratio area on the side richer than a predetermined air-fuel ratio range including the stoichiometric air-fuel ratio and an air-fuel ratio area on the side leaner than the predetermined air-fuel ratio range.

15. A cylinder-by-cylinder air-fuel ratio controlling method for an internal combustion engine according to claim 14, wherein when the target air-fuel ratio or the detected air-fuel ratio is in the predetermined air-fuel ratio range including the stoichiometric air-fuel ratio, a correction amount for the air-fuel ratio detection timing is set by interpolation correction between an adaptation value in the rich-side air-fuel ratio area and an adaptation value in the lean-side air-fuel ratio area, which are adapted by the adaptation means.

16. A cylinder-by-cylinder air-fuel ratio controlling method for an internal combustion engine according to claim 12, wherein a control for changing the air-fuel ratio during an operation of adapting a deviation from the proper value of the air-fuel ratio detection timing is inhibited.

17. A cylinder-by-cylinder air-fuel ratio controlling method for an internal combustion engine according to claim 12, wherein the adaptation operation is executed at predetermined intervals to update an adaptation value in accordance with a change with time in response of the air-fuel ratio sensor.

18. A cylinder-by-cylinder air-fuel ratio controlling method for an internal combustion engine according to claim 12, wherein time when the air-fuel ratio is changed to a lean side or a rich side and adaptation operation is performed is determined on the basis of a state of a catalyst for purifying exhaust gas.

* * * * *